US011122892B2

(12) United States Patent
Chen et al.

(10) Patent No.: US 11,122,892 B2
(45) **Date of Patent: *Sep. 21, 2021**

(54) APPARATUS AND METHOD FOR PULLOUT CAGE MOUNTING AND ADJUSTMENT

(71) Applicant: Hardware Resources, Inc., Bossier City, LA (US)

(72) Inventors: Alan Chen, Lewisville, TX (US); Justin Corless, Flower Mound, TX (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/709,299

(22) Filed: Dec. 10, 2019

(65) Prior Publication Data

US 2020/0138190 A1 May 7, 2020

Related U.S. Application Data

(63) Continuation of application No. 15/940,605, filed on Mar. 29, 2018, now Pat. No. 10,499,736.

(51) Int. Cl.

| | |
|---|---|
| ***A47B 88/407*** | (2017.01) |
| ***A47B 88/956*** | (2017.01) |
| ***A47B 88/40*** | (2017.01) |

(52) U.S. Cl.

CPC ..... *A47B 88/407* (2017.01); *A47B 88/956* (2017.01); *A47B 2088/401* (2017.01)

(58) Field of Classification Search

CPC ..... A47B 88/00; A47B 88/40; A47B 88/407; A47B 88/0407; A47B 88/42; A47B 88/0485; A47B 88/423; A47B 88/0418; A47B 88/427; A47B 88/0422; A47B 88/90; A47B 88/931; A47B 88/0085; A47B 88/956; A47B 88/0055; A47B 2088/401; A47B 2088/0448; A47B 2088/422; A47B 2088/0492; A47B 2088/4272; A47B 2088/0425; A47B 2088/4274; A47B 2088/0429; A47B 2088/4276; A47B 2088/0433; A47B 2088/4278; A47B 2088/0437; A47B 2088/952; A47B 2088/0062; A47B 2210/0024;

(Continued)

(56) References Cited

U.S. PATENT DOCUMENTS

| | | | |
|---|---|---|---|
| 5,083,848 | A | 1/1992 | Merino et al. |
| 6,199,966 | B1 | 3/2001 | Fulterer |

(Continued)

FOREIGN PATENT DOCUMENTS

| | | |
|---|---|---|
| DE | 202011050248 | 10/2012 |
| EP | 1639917 | 3/2006 |
| WO | 2009080403 | 7/2009 |

*Primary Examiner* — Andrew M Roersma

(74) *Attorney, Agent, or Firm* — Schultz & Associates, P.C.

(57) ABSTRACT

A pullout cage apparatus is provided which is comprised of a base frame removably mounted to a pair of robust drawer slides. The drawer slides are coupled to each other by a pair of cross braces, which are in turn mounted to the base of a cabinet frame. A retainer cage is rigidly mounted to the base frame. The retainer cage supports a plurality of adjustment brackets, which allow adjustment of a face plate.

14 Claims, 22 Drawing Sheets

(58) Field of Classification Search
CPC ..... A47B 2210/04; A47B 2210/05; A47B 2210/06; A47B 77/04; A47B 77/18
See application file for complete search history.

(56) References Cited

U.S. PATENT DOCUMENTS

| | | | | |
|---|---|---|---|---|
| 6,390,576 | B1 | 5/2002 | Walburn | |
| 6,629,738 | B2 * | 10/2003 | Salice | E05F 5/027 312/319.1 |
| 7,370,919 | B2 | 5/2008 | Rapier, III | |
| RE41,725 | E | 9/2010 | Walburn | |
| 7,810,890 | B2 | 10/2010 | Klein et al. | |
| 7,832,816 | B2 | 11/2010 | Compagnucci | |
| 8,047,621 | B2 | 11/2011 | Walburn | |
| D692,666 | S | 11/2013 | Goodman et al. | |
| 8,939,526 | B1 | 1/2015 | Chambers et al. | |
| 9,185,976 | B2 | 11/2015 | Chen et al. | |
| 9,693,627 | B2 * | 7/2017 | Chen | A47B 88/403 |
| 10,499,736 | B2 * | 12/2019 | Chen | A47B 77/18 |
| 2007/0182293 | A1 | 8/2007 | Compagnucci | |
| 2009/0261700 | A1 * | 10/2009 | Chen | A47B 88/427 312/334.46 |
| 2012/0146476 | A1 | 6/2012 | Tibbe | |
| 2013/0088134 | A1 | 4/2013 | Varner et al. | |
| 2014/0314347 | A1 * | 10/2014 | Huang | A47B 88/407 384/22 |
| 2016/0058187 | A1 | 3/2016 | Balducci | |

* cited by examiner

APPARATUS AND METHOD FOR PULLOUT CAGE MOUNTING AND ADJUSTMENT

CROSS-REFERENCE TO RELATED APPLICATIONS

This application is a continuation of application Ser. No. 15/940,605 filed Mar. 29, 2018, now U.S. Pat. No. 10,499,736, granted on Dec. 10, 2019. The patent application identified above is incorporated here by reference in its entirety to provide continuity of disclosure.

FIELD OF THE INVENTION

The present disclosure relates to pullout drawers in cabinets. In particular, the disclosure relates to a pullout drawer systems having adjustable face plate panels.

BACKGROUND OF THE INVENTION

Modern kitchens place a premium on both high quality cabinetry and efficient storage. In the past, traditional pullout drawers have been built into cabinets from cabinetry wood. However, wood drawers are both heavy and difficult to clean. Moreover, wooden drawers are difficult to adjust properly, which makes mounting them in a way which aligns with the cabinet face difficult and costly. Further, prior art wooden pullout drawers are not easily removable for cleaning, which makes them difficult to use for trash receptacles.

In an effort to overcome these difficulties, the prior art has responded by various pullout drawer systems.

For example, U.S. Publication No. US2013/0088134 to Varner, et al. discloses a storage and organization system for garbage cabinet including pullouts and accessories constructed to fit closely into differently sized storage spaces to increase efficiency and capacity. However, the system includes many solid pieces, making it heavy, difficult to install, and difficult to adjust.

U.S. Pat. No. 7,832,816 to Compagnucci discloses a frame used to support racks that slide out from a cabinet and rotate around a vertical axis. The frame comprises a rectangular structure formed of two uprights connected by upper and lower cross-pieces. The cross-pieces are coupled to telescopic sliding assemblies mounted within the cabinet. The cross-pieces are pinned to the sliding assemblies to allow the rack to rotate approximately 90° on a vertical axis such that the frame becomes parallel with the face of the cabinet only at a fully deployed position. Stops mounted to the cross-pieces prevent the frame from sliding to a stored position within the cabinet before the frame is rotated 90° such that the frame is parallel with the sliding assemblies. The device does not provide a lightweight structure.

U.S. Pat. No. 6,199,966 to Fulterer discloses a pullout device for a tall cupboard. The device comprises upper and lower sliding assemblies including telescopically sliding rails and running rollers. A vertically extending pullout frame, which is formed of vertical front and rear bars and horizontal upper and lower bars, is secured to the sliding assemblies. The front and rear bars and the upper and lower bars can be formed as telescopic members, permitting to adapt the device to the dimensions of the tall cupboard. A plurality of baskets can be hung between the vertical. A frontal screen is secured to the front vertical bar. The frontal screen is not easily adjustable.

U.S. Pat. No. RE41,725 to Walburn discloses a drawer slide system providing desired access and stability for a side access drawer. The system comprises a drawer having a front wall, a back wall, a base, and plurality of shelves connected between the front and back walls. The base includes a pair of vertical webs. The base is slidably mounted on a sliding assembly comprised of one horizontally oriented drawer slide and a pair of vertically oriented drawer slides mounted to vertical webs of the base. The device does not provide easy adjustment and is not removable.

Despite the advantages of the prior art, a major drawback has been that the pullout drawers disclosed are not easily installed, adjusted or cleaned. The prior art fails to disclose or suggest a pullout drawer that is lightweight and which is both easily adjustable to accommodate alignment with adjacent cabinets and easily removed for cleaning. Therefore, there is a need for a pullout drawer that is lightweight, easily adjustable to ensure a coordinated appearance with preexisting cabinetry and easily removable for cleaning.

SUMMARY OF THE INVENTION

In preferred embodiment, a pullout retainer cage assembly is comprised of a base frame removably mounted to a pair of robust drawer slides. The drawer slides are coupled to each other by a pair of cross braces which are in turn, mounted to the base of a cabinet frame. The retainer cage is rigidly mounted to the base frame. The retainer cage includes several generally horizontal cage rails rigidly mounted by vertical stanchions in a particularly strong arrangement which forms three distinct top planes. The support rails and vertical stanchions support a plurality of adjustment brackets, which allow a novel aligned adjustment capability the face plate. The retainer cage assembly, base frame and drawer slides are moveable between a retracted position and an extended position. In a preferred embodiment, the drawer slides include automatic retraction and damping mechanisms to aid in control of movement between the retraced position and the extended position.

BRIEF DESCRIPTION OF THE DRAWINGS

The disclosed embodiments will be described with reference to the accompanying drawings. Like pieces in different drawings are referenced by the same number.

DETAILED DESCRIPTION OF THE INVENTION

Figure 1:
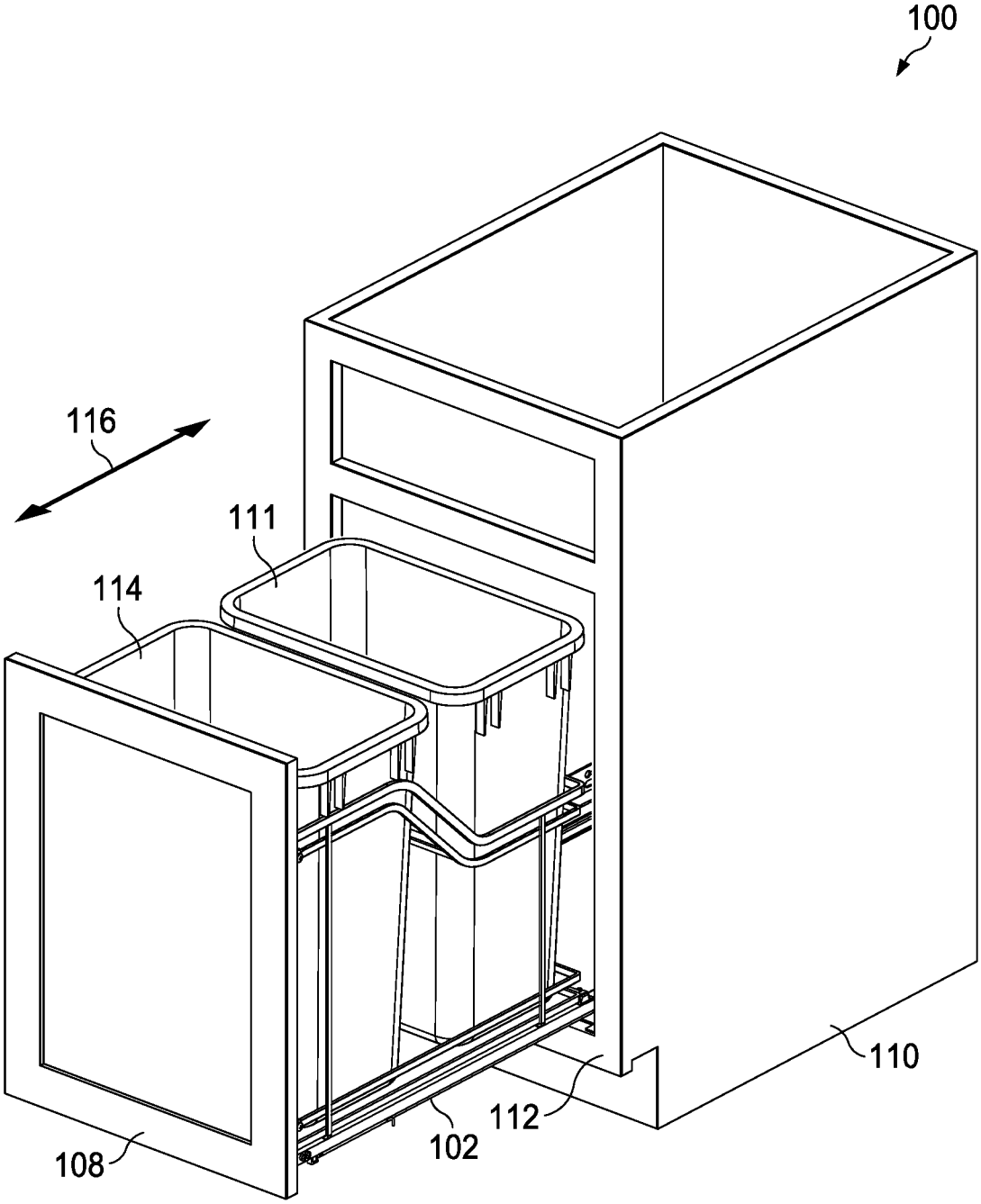
FIG. 1 is an isometric view of a preferred embodiment in an extended position.

Referring to FIG. 1, pullout cage 100 comprises retainer cage assembly 102, removably connected a pair of drawer slides (as will be further described). The drawer slides are rigidly mounted to the interior of drawer box 110. Drawer box 110 has front face 112. The retainer cage assembly adjustably supports face plate 108 in a position generally parallel to and abutting front face 112. The retainer cage is designed to removably support refuse container 111 and refuse container 114. In a preferred embodiment, the two refuse containers may be of different sizes, with refuse container 114 being of greater height than refuse container 111. As indicated by arrow 116, the retainer cage assembly is movable between a retracted position within the drawer box, and an extended position (as shown) in which access can be had to the refuse containers. The retainer cage can be removed completely from the drawer slides for cleaning and for ease of adjustment and maintenance.

Figure 2:
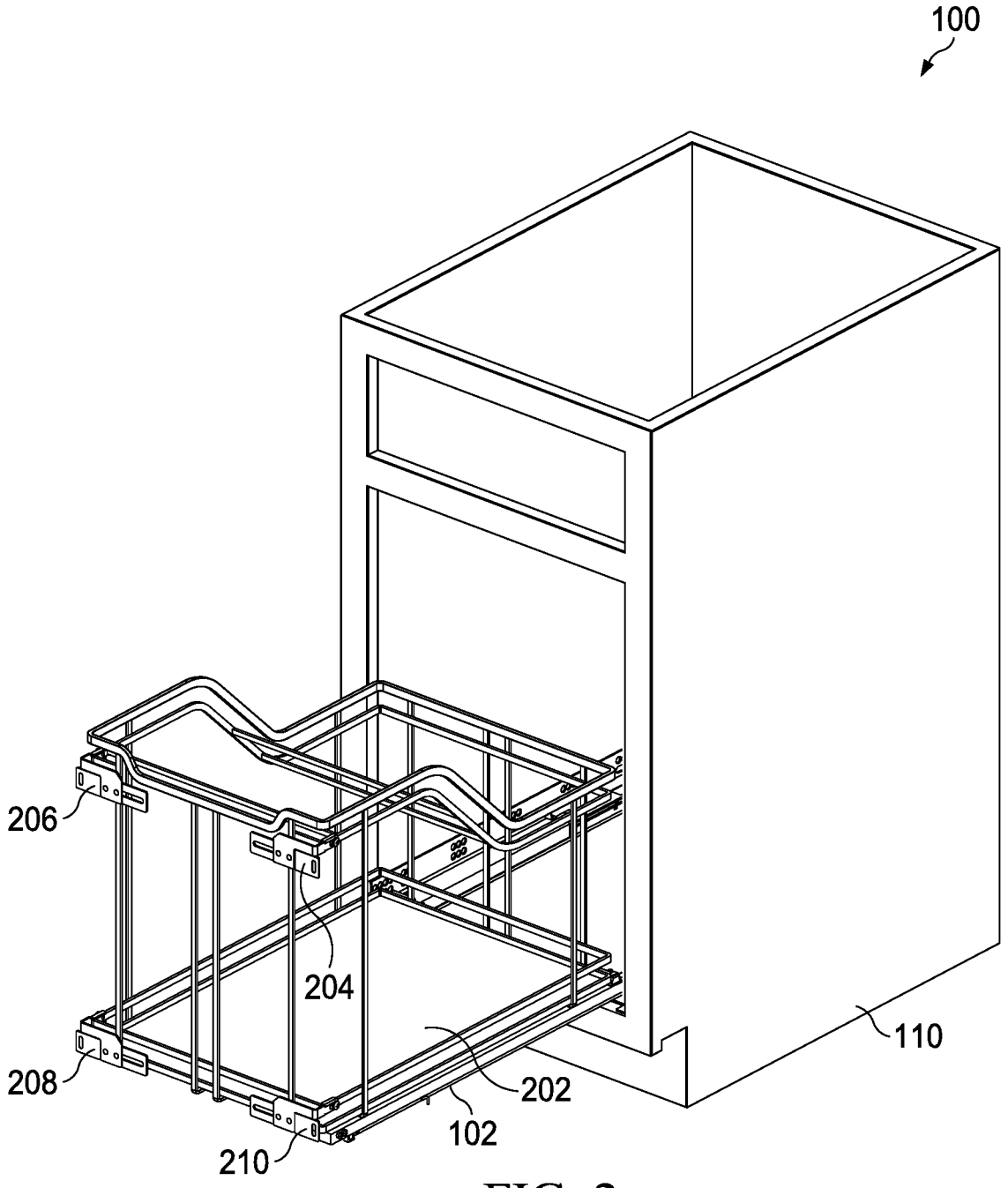
FIG. 2 is an isometric view of preferred embodiment having the face plate removed.
Figure 3A:
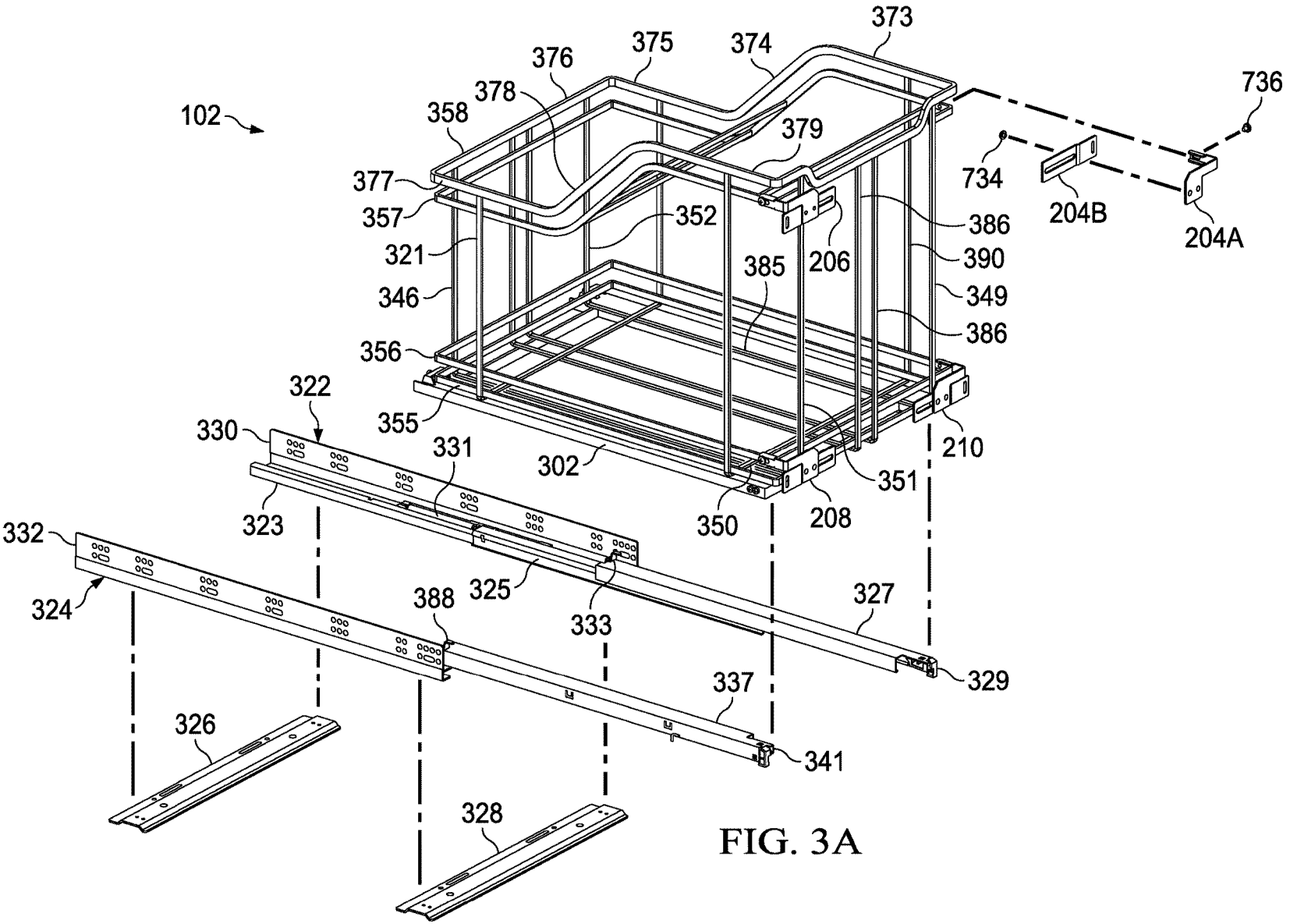
FIG. 3A is an exploded isometric view of a preferred embodiment.
Figure 3B:
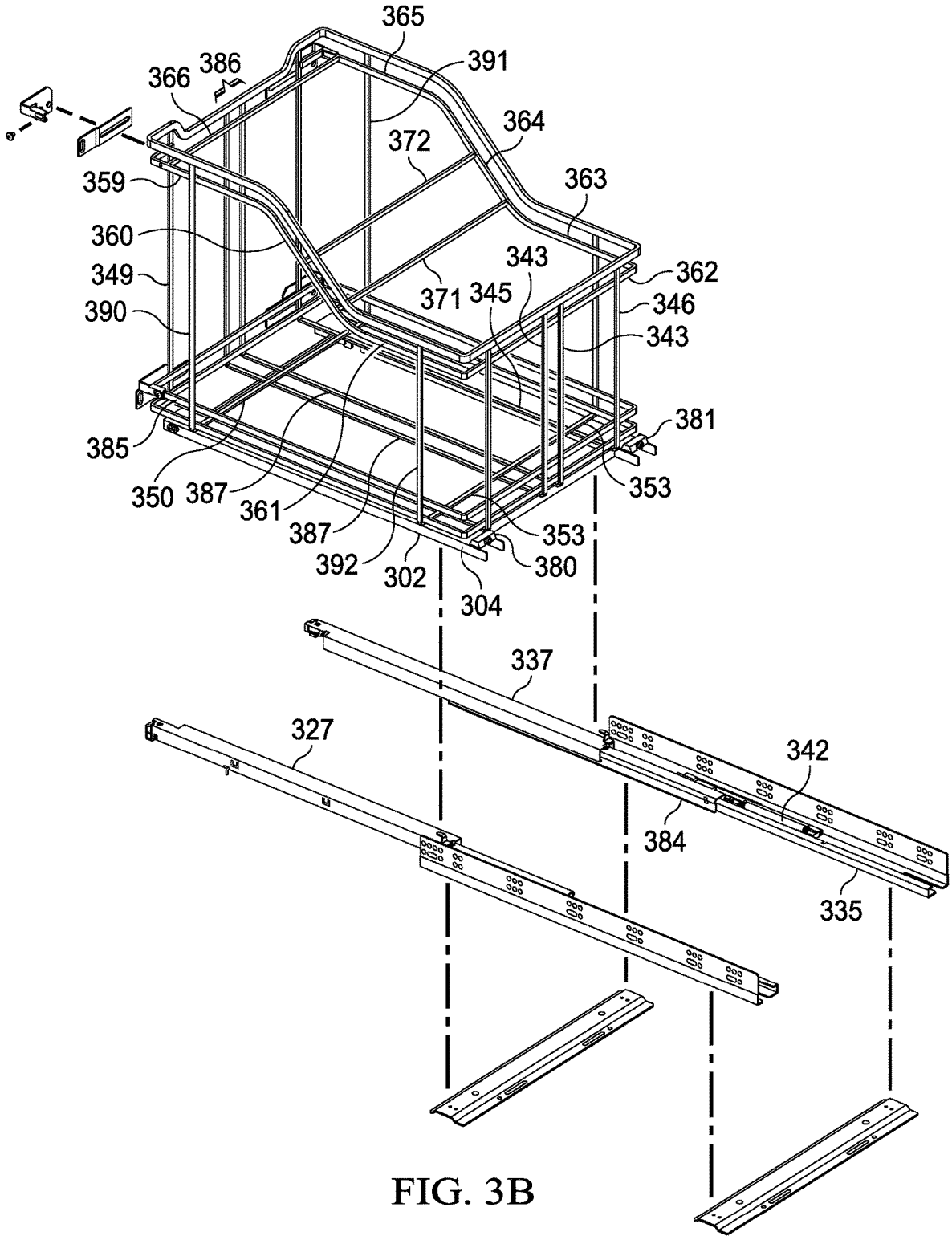
FIG. 3B is an exploded isometric view of a preferred embodiment.
Figure 3C:
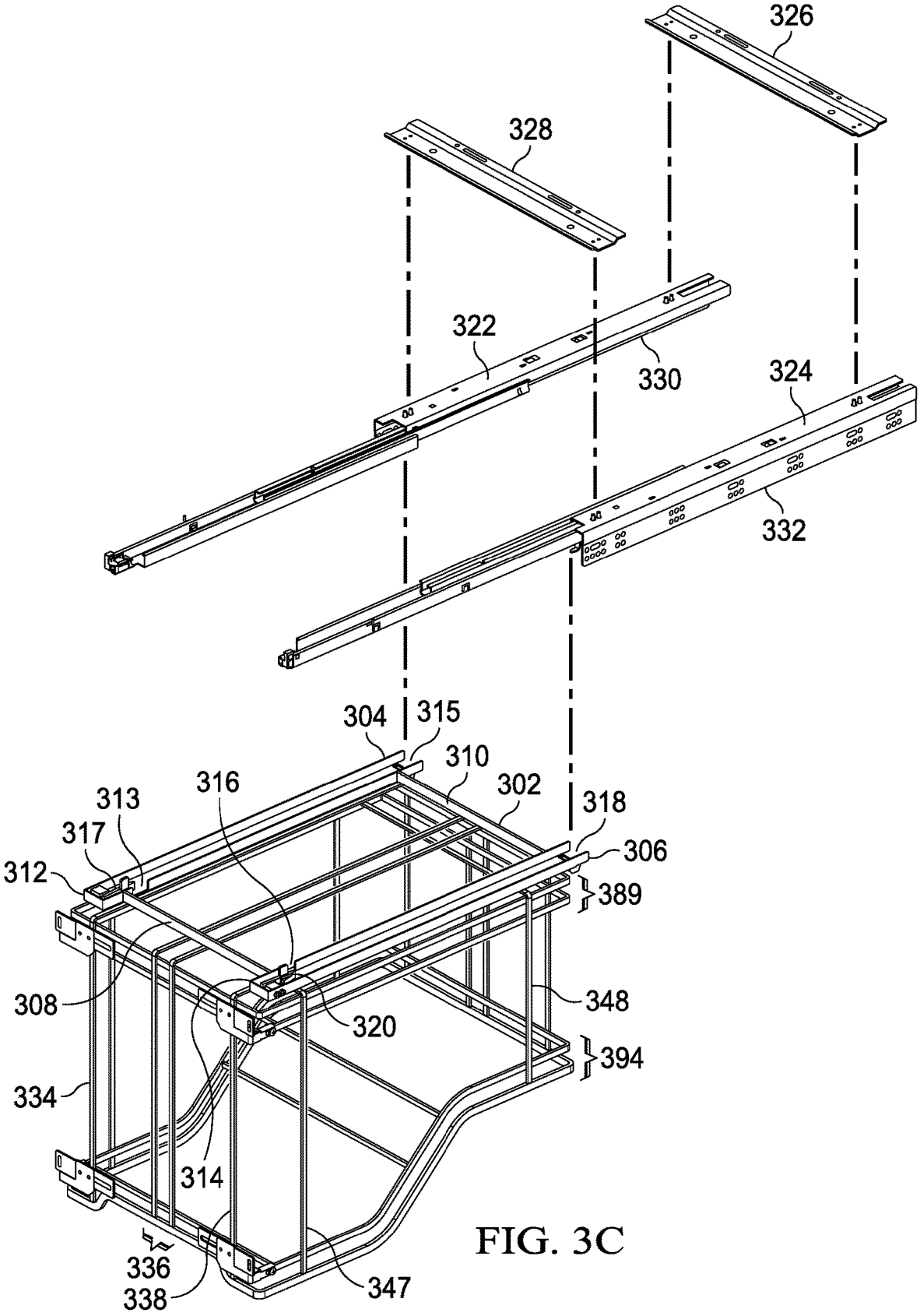
FIG. 3C is an exploded isometric view of a preferred embodiment.
Figure 3D:
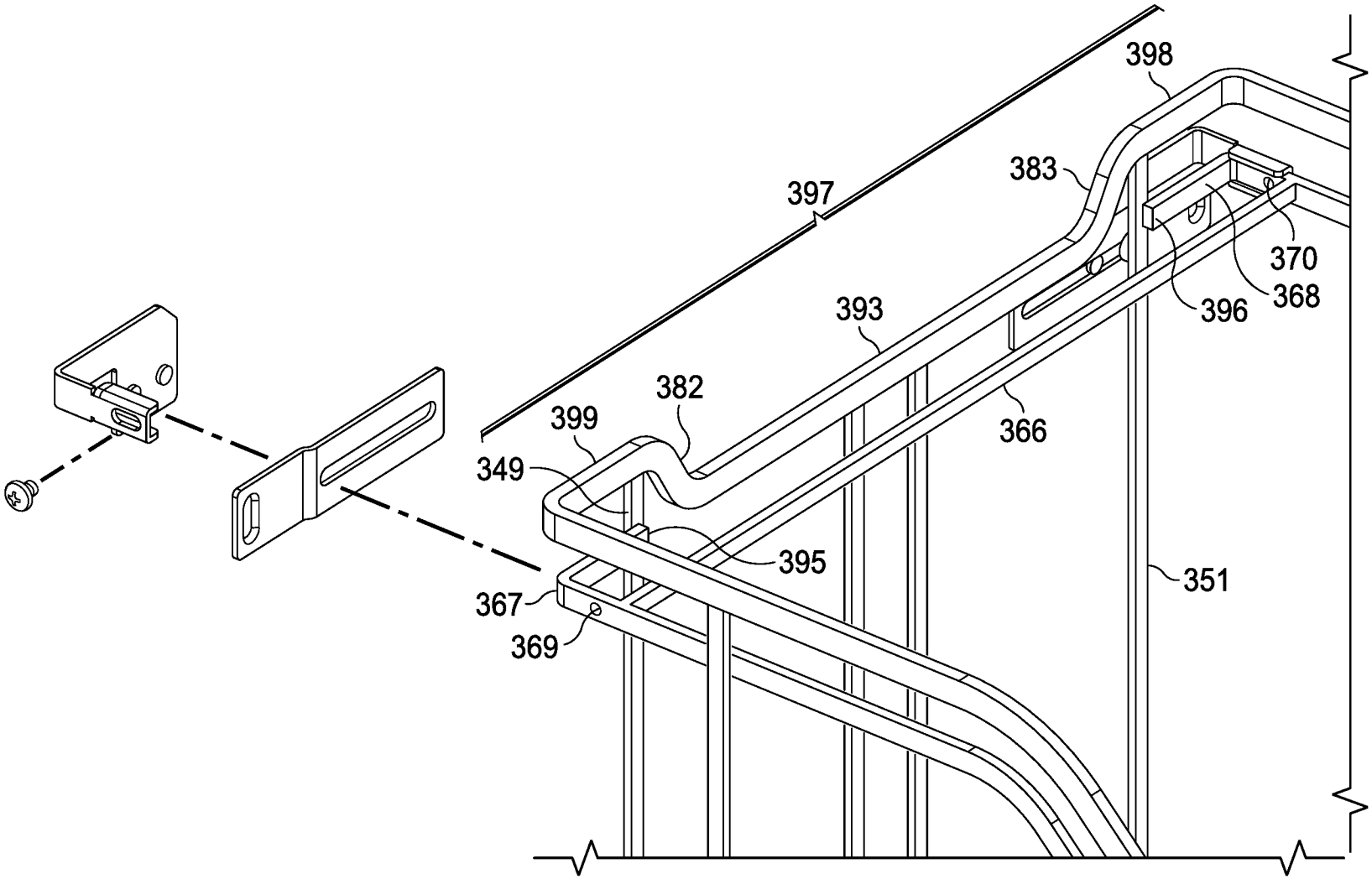
FIG. 3D is an isometric detail view of a preferred embodiment.

Referring then to FIG. 2, retainer cage assembly 102 supports drip panel 202 and adjustment brackets 204, 206, 208 and 210. In a preferred embodiment, the adjustment brackets are positioned at the upper right, upper left, lower left and lower right corners of the retainer cage assembly. The drip panel may be removed for ease of cleaning. In a preferred embodiment, adjustment brackets 206 and 208 are mirror images of adjustment brackets 204 and 210, respectively. In a preferred embodiment, the adjustment brackets are adjustably mounted on the retainer cage assembly and to a backside of face plate 108.

Referring to FIGS. 3A, 3B, 3C and 3D, the retainer cage assembly and various mounting components will be described. As seen best in FIG. 3C, base frame 302 is comprised of right base channel member 304, and left base channel member 306. Right base channel member 304 is connected to left base channel member 306 by front support beam 308 and rear support beam 310. In a preferred embodiment, the base channel members are attached to the support beams by welding. In a preferred embodiment, right base channel member 304 and left base channel member 306 are "U" shaped channel members comprised of a light steel alloy, or stainless steel. Right base channel member 304 includes right box end 312, right access cutout 313 and right guide slot 315. Left base channel member 306 includes left box end 314, left access cutout 316 and left guide slot 318.

Right abutment block 380 is positioned at the rear right base channel member 304 directly adjacent right guide slot 315, as will be further described. Left abutment block 381 is positioned at the rear of left base channel member 306 directly adjacent left guide slot 318, as will be further described.

Right base channel member 304 further comprises right drawer slide clip 317, adjacent right box end 312 and right access cutout 313, as will be further described. Left base channel member 306 further comprises left drawer slide clip 320, adjacent left box end 314 and left access cutout 316, as will be further described. Right base channel member 304 is removably connected to right drawer slide 322, as will be further described. Left base channel member 306 is removably connected to left drawer slide 324, as will be further described. In a preferred embodiment, the drawer slides are Part No. USE 58-300-21 available from Hardware Resources, Inc. of Bossier City, La. Right drawer slide 322 and left drawer slide 324 are rigidly connected by rear cross brace 326 and front cross brace 328. In a preferred embodiment, the cross braces are connected to the drawer slide by removable machine screws. In another preferred embodiment, the drawer slides are connected to the cross braces by spot welding. The cross braces are positioned and attached to the drawer slides in such a way as to maintain the drawer slides generally parallel to each other. The cross braces are mounted to the interior of drawer box 110 by right side mount bracket 330 and left side mount bracket 332, by wood screws.

Base frame 302 is rigidly attached to right longitudinal stanchion 334, central support stanchion pair 336, and left longitudinal stanchion 338. Right longitudinal stanchion 334 further comprises longitudinal right front vertical section 349, right longitudinal section 385 and longitudinal right rear vertical section 352. Central support stanchion pair 336 further comprises longitudinal central front vertical section pair 386, central longitudinal section pair 387, and longitudinal central rear vertical section pair 343. Left longitudinal stanchion 338 further comprises longitudinal left front vertical section 351, left longitudinal section 345, and longitudinal left rear vertical section 346. In a preferred embodiment, rear support beam 310 and front support beam 308 are spot welded to each of right longitudinal section 385, central longitudinal section pair 387, and left longitudinal section 345. In a preferred embodiment, right longitudinal stanchion 334 central support stanchion pair 336, and left longitudinal stanchion 338 are all integrally formed of drawn steel wire, rectangular in cross section and having approximately one quarter (¼) inch width and one quarter (¼) inch height.

Retainer cage assembly 102 further comprises front latitudinal stanchion 347 and rear latitudinal stanchion 348. Front latitudinal stanchion 347 further comprises latitudinal right front vertical section 390, front latitudinal section 350, and latitudinal left front vertical section 391. Rear latitudinal stanchion 348 further comprises latitudinal right rear vertical section 392, rear latitudinal section 353, and latitudinal left rear vertical section 321. In a preferred embodiment, front latitudinal stanchion 347 and rear latitudinal stanchion 348 are each integrally formed from drawn steel wire, having a rectangular cross section with approximately one quarter (¼) inch height and one quarter (¼) inch width.

Front latitudinal stanchion 347 and rear latitudinal stanchion 348 are each welded to right longitudinal stanchion 334, central support stanchion pair 336 and left longitudinal stanchion 338 and form supports for drip panel 202.

Right longitudinal stanchion 334, central support stanchion pair 336, left longitudinal stanchion 338, front latitudinal stanchion 347 and rear latitudinal stanchion 348 are all connected to and held in place by lower perimeter rail 355, lower buttress rail 356, upper buttress rail 357, and upper perimeter rail 358.

Lower perimeter rail 355 forms an integrated rectangle comprised of one quarter (¼) inch by three sixteenths (3/16) inch rectangular drawn steel wire. Lower perimeter rail 355 contacts and is welded to each of right longitudinal stanchion 334, central support stanchion pair 336, left longitudinal stanchion 338, front latitudinal stanchion 347 and rear latitudinal stanchion 348. Likewise, lower buttress rail 356 forms an integrated rectangle comprised of one quarter (¼) inch by three sixteenths (3/16) inch rectangular drawn steel wire. Lower buttress rail 356 contacts and is welded to right longitudinal stanchion 334, central support stanchion pair 336, left longitudinal stanchion 338, front latitudinal stanchion 347 and rear latitudinal stanchion 348. In a preferred embodiment, lower perimeter rail 355 is positioned generally coplanar to lower buttress rail 356. Together, lower perimeter rail 355 and lower buttress rail 356 form lower buttress box 389. The lower buttress box is important because it adds great strength and rigidity to the retainer cage assembly. In a preferred embodiment drip panel 202 is sized to fit within and be sealingly bounded by lower perimeter rail 355 and be supported by front latitudinal section 350 and rear latitudinal section 353.

Upper buttress rail 357 further comprises upper buttress right top section 359, upper buttress right midsection 360, upper buttress right bottom section 361, upper buttress rear section 362, upper buttress left bottom section 363, upper buttress left midsection 364, upper buttress left top section 365 and upper buttress front section 366. In a preferred embodiment, upper buttress rail 357 is integrally formed of rectangular drawn steel wire having a rectangular cross section approximately one quarter (¼) inch height by three sixteenths (3/16) inch width. Upper buttress front section 366 further comprises right upper buttress rail extension 367 and left upper buttress rail extension 368. Right upper buttress rail extension 367 forms an angular bracket extending forward of upper buttress front section 366 and includes threaded hole 369. Left upper buttress rail extension 368 also forms an angular bracket extending forward of upper buttress front section 366 and includes threaded hole 370. Right upper buttress rail extension 367 is welded to longitudinal right front vertical section 349 at connection point 395. Left upper buttress rail extension 368 is welded to longitudinal left front vertical section 351 at connection point 396. Lower brace 371 is welded to upper buttress right midsection 360 and upper buttress left midsection 364. Likewise, upper brace 372 is welded to upper buttress right midsection 360 and upper buttress left midsection 364. The upper brace and lower brace strengthen the structure of the retainer cage assembly 102 and serve to separate refuse containers 111 and 114 when in use. Upper buttress rail 357, in general, forms three intersecting planes. The first intersecting plane is bounded by upper buttress right top section 359, upper buttress front section 366 and upper buttress left top section 365. The second intersecting plane is bounded by upper buttress right midsection 360 and upper buttress left midsection 364. The third intersecting plane is bounded by upper buttress right bottom section 361, upper buttress rear section 362 and upper buttress left bottom section 363. In a preferred embodiment, the second intersecting plane is formed at an approximate forty-five degree (45°) angle (±10°) to both the first intersecting plane and the third intersecting plane. Upper buttress rail 357 contacts and is welded to each of latitudinal right front vertical section 390, latitudinal left front vertical section 391, latitudinal left rear vertical section 392, longitudinal left rear vertical section 346, longitudinal central rear vertical section pair 343, longitudinal right rear vertical section 352, and latitudinal right rear vertical section 392.

Upper perimeter rail 358 further comprises upper perimeter rail right top section 373, upper perimeter rail right midsection 374, upper perimeter rail right bottom section 375, upper perimeter rail rear section 376, upper perimeter rail left bottom section 377, upper perimeter rail left midsection 378, upper perimeter rail left top section 379 and upper perimeter rail front section 397. Upper perimeter rail front section 397 further comprises left connector section 398, left slope section 383, front horizontal section 393, right slope section 382 and right connector section 399. Both sloped sections are at approximately forty-five degree (45°) angles (±10°) to front horizontal section 393. In a preferred embodiment, upper perimeter rail 358 is integrally formed of drawn steel wire, rectangular in cross section of approximately three quarters (¾) inch in height, and three sixteenths (3/16) inch width. Upper perimeter rail right top section 373 is welded to the top of latitudinal right front vertical section 390. Upper perimeter rail right bottom section 375 is welded to the top of latitudinal right rear vertical section 392. Upper perimeter rail rear section 376 is welded to the top of longitudinal right rear vertical section 352, the top of each of longitudinal central rear vertical section pair 343, and the top of longitudinal left rear vertical section 346. Upper perimeter rail left bottom section 377 is welded to the top of latitudinal left rear vertical section 321. Upper perimeter rail left top section 379 is welded to the top of latitudinal left front vertical section 391. Upper perimeter rail front section 397 is welded to the top of longitudinal right front vertical section 349 and the top of longitudinal left front vertical section 351. In general, upper perimeter rail 358 forms three intersecting planes. The first intersecting plane is bounded by upper perimeter rail right bottom section 375, upper perimeter rail rear section 376 and upper perimeter rail left bottom section 377. The second intersecting plane is bounded by upper perimeter rail right midsection 374 and upper perimeter rail left midsection 378. The third intersecting plane is bounded by upper perimeter rail right top section 373 and upper perimeter rail left top section 379. The difference in height between the first intersecting plane and the third intersecting plane is provided to accommodate refuse containers of different heights and is important. Together, upper perimeter rail 358 and upper buttress rail 357 form upper buttress box 394. Upper buttress box 394 is important because it adds great strength and rigidity to the retainer cage assembly. In other preferred embodiments, retainer cage assembly 102 can comprise further buttress rails of structure similar or identical to the upper buttress rail and/or the lower buttress rail for additional strength and rigidity.

Right drawer slide 322 is comprised of right bearing race 323, integrally formed with right side mount bracket 330. Right mid slide rail 325 includes linear bearings (not shown), which ride on right bearing race 323. Right mid slide rail 325 also forms an external bearing race on its upper surface. Right forward slide rail 327 includes internal linear bearings (not shown) which ride on right mid slide rail 325. Integrally formed in right forward slide rail 327 is right engagement block 329, as will be further described. Right damper 331 is positioned adjacent to right bearing race 323 and is designed to engage right forward slide rail 327 when the drawer slide is transitioned between an extended and a retracted position. Right forward slide rail 327 further comprises right drawer slide catch 333. Right drawer slide catch 333 is integrally formed with right forward slide rail 327 and forms an angular hook, as will be further described.

Likewise, left drawer slide 324 includes left bearing race 335. Left bearing race 335 in a preferred embodiment is integrally formed with left side mount bracket 332. Left mid slide rail 384 includes linear bearings (not shown), which ride on left bearing race 335. Left mid slide rail 384 also includes an external bearing race on its upper surface. Left forward slide rail 337 includes linear bearings (not shown), which ride on left mid slide rail 384. Left forward slide rail 337 further comprises left engagement block 341, as will be further described. Left damper 342 is positioned adjacent left side mount bracket 332 and designed to engage left forward slide rail 337 to provide motion control when left forward slide rail 337 transitions between an extended position and a retracted position. Left forward slide rail 337 further comprises left drawer slide catch 388. Left drawer slide catch 388 is integrally formed with left forward slide rail 337 and forms and angular hook, as will be further described.

Figure 4A:
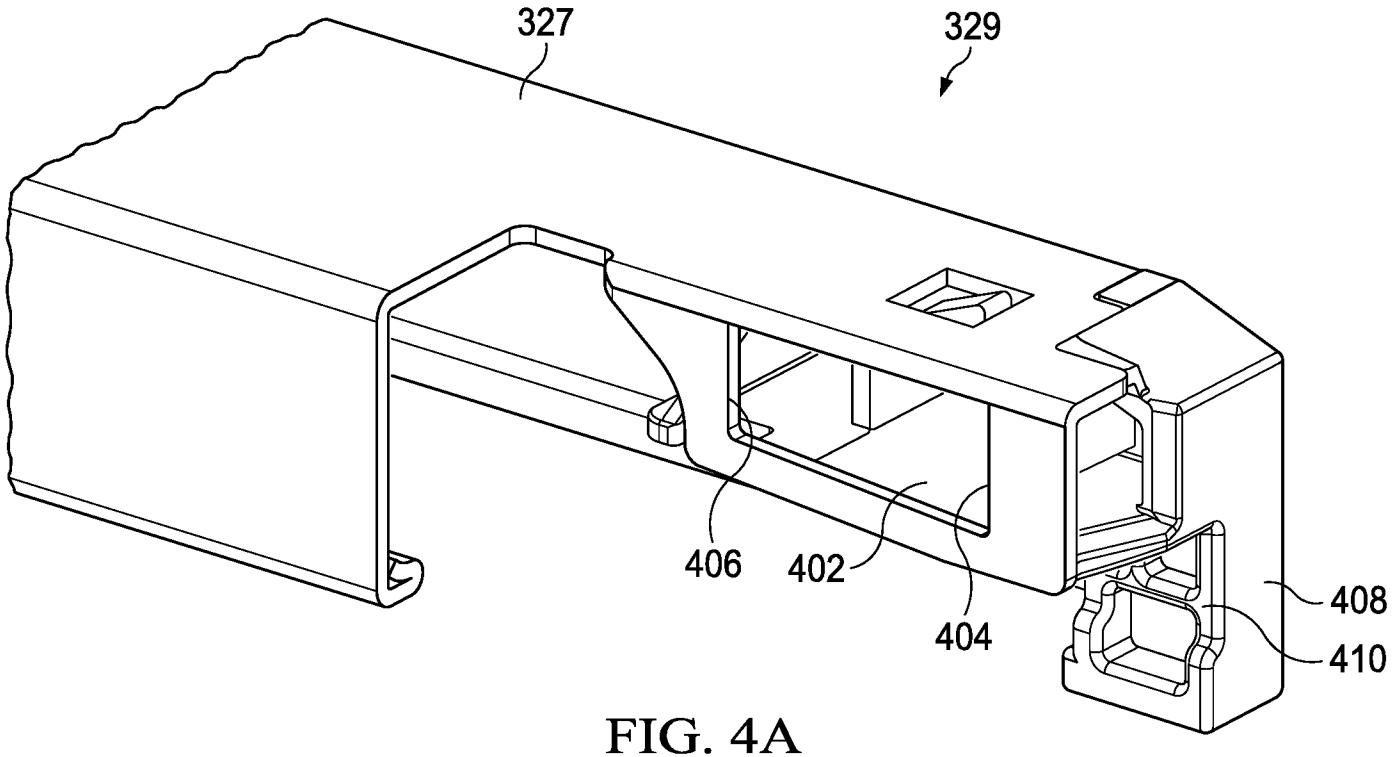
FIG. 4A is an isometric detail view of a drawer slide of preferred embodiment.
Figure 4B:
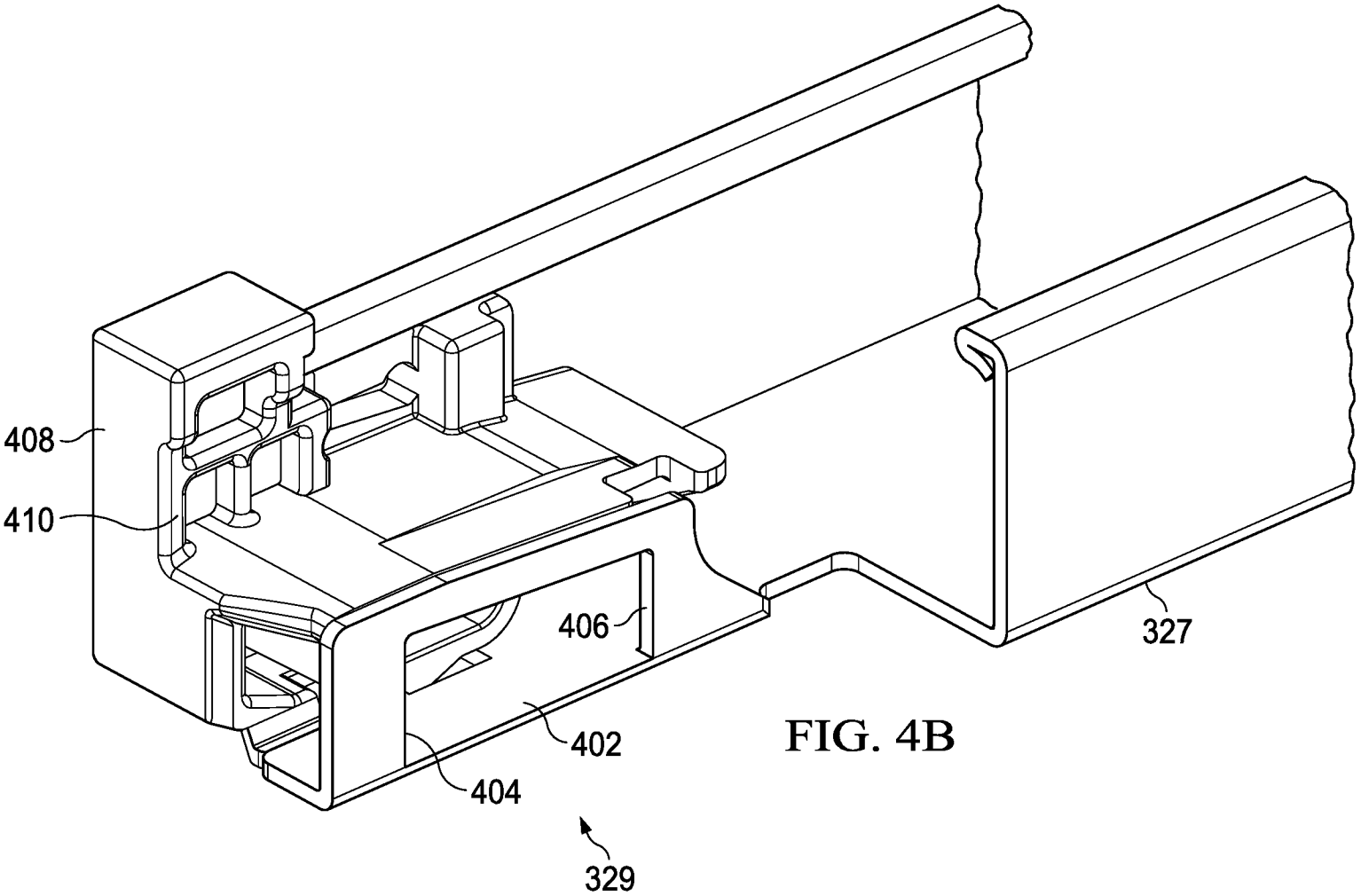
FIG. 4B is an isometric detail view of a drawer slide of preferred embodiment.

Referring to FIGS. 4A and 4B, an example of right engagement block 329 will be described. Right engagement block 329 includes clip receiver 402 positioned vertically with respect to right forward slide rail 327. Clip receiver 402 is a rectangular hole integrally formed with right forward slide rail 327 and further comprises forward catch 404 and rearward catch 406. Forward catch 404 is a vertical edge of clip receiver 402. Rearward catch 406 is also a vertical edge of clip receiver 402. Right engagement block 329 further comprises an engagement clip stop 408 formed at the end of right forward slide rail 327. Engagement clip stop 408 forms a right angle face with the longitudinal axis of right forward slide rail 327. Right engagement block 329 further comprises engagement clip guide channel 410 and adjacent engagement clip stop 408, as will be further described.

In a preferred embodiment, left engagement block 341 comprises a mirror image of right engagement block 329, and will not be described further.

Figure 4C:
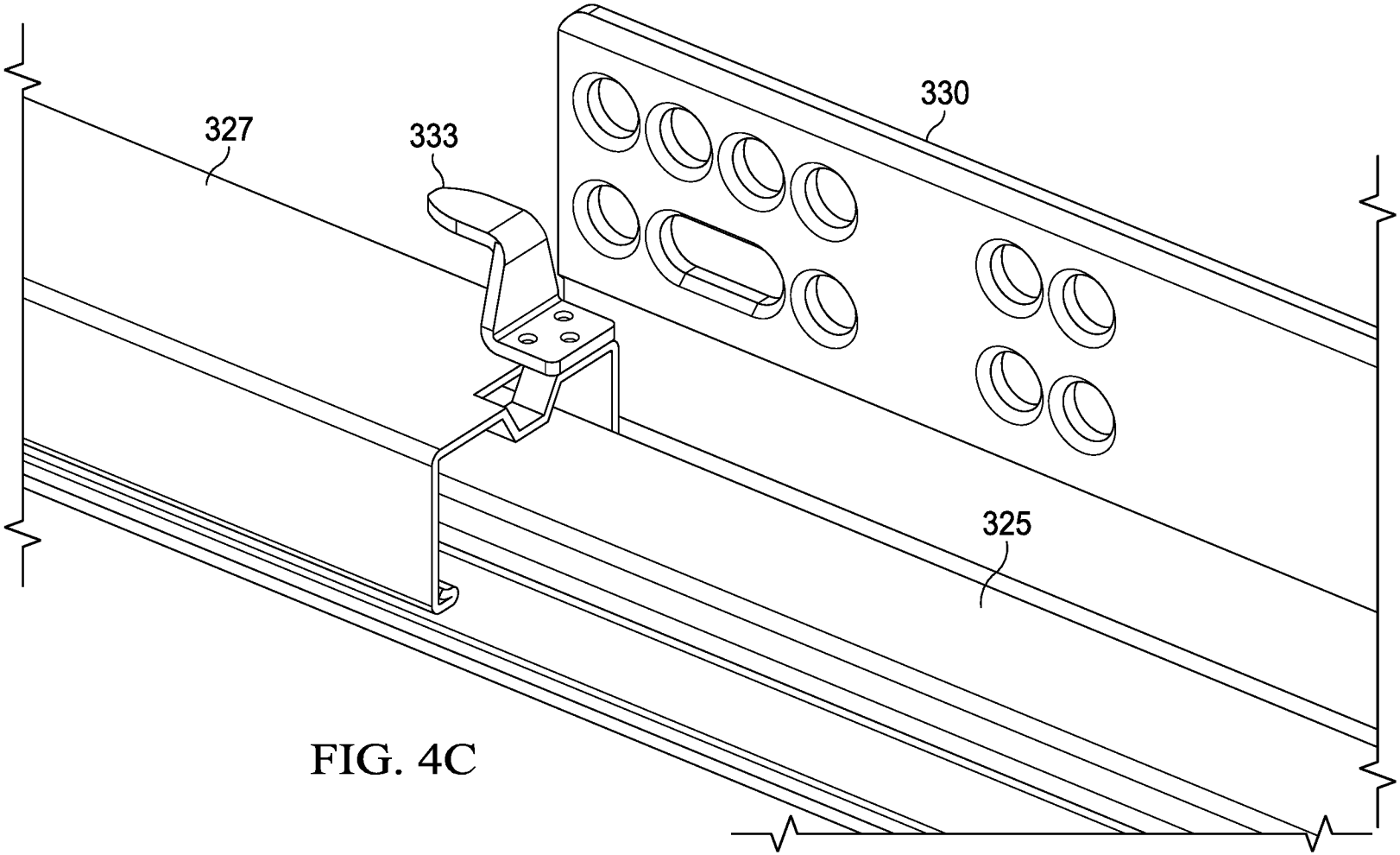
FIG. 4C is an isometric detail view of a drawer slide of preferred embodiment
Figure 5A:
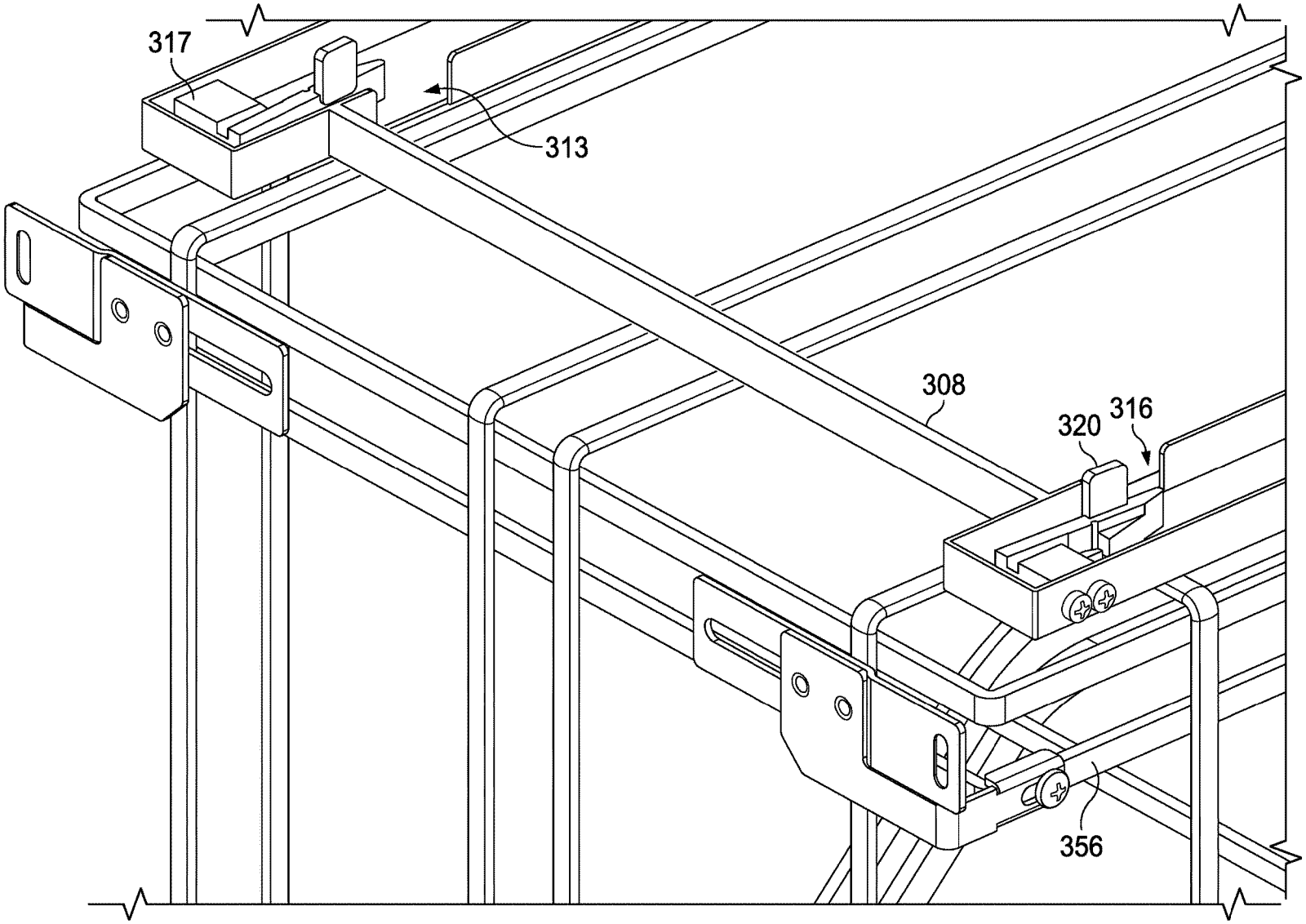
FIG. 5A is an isometric detail view of a preferred embodiment of a drawer slide clip.
Figure 5B:
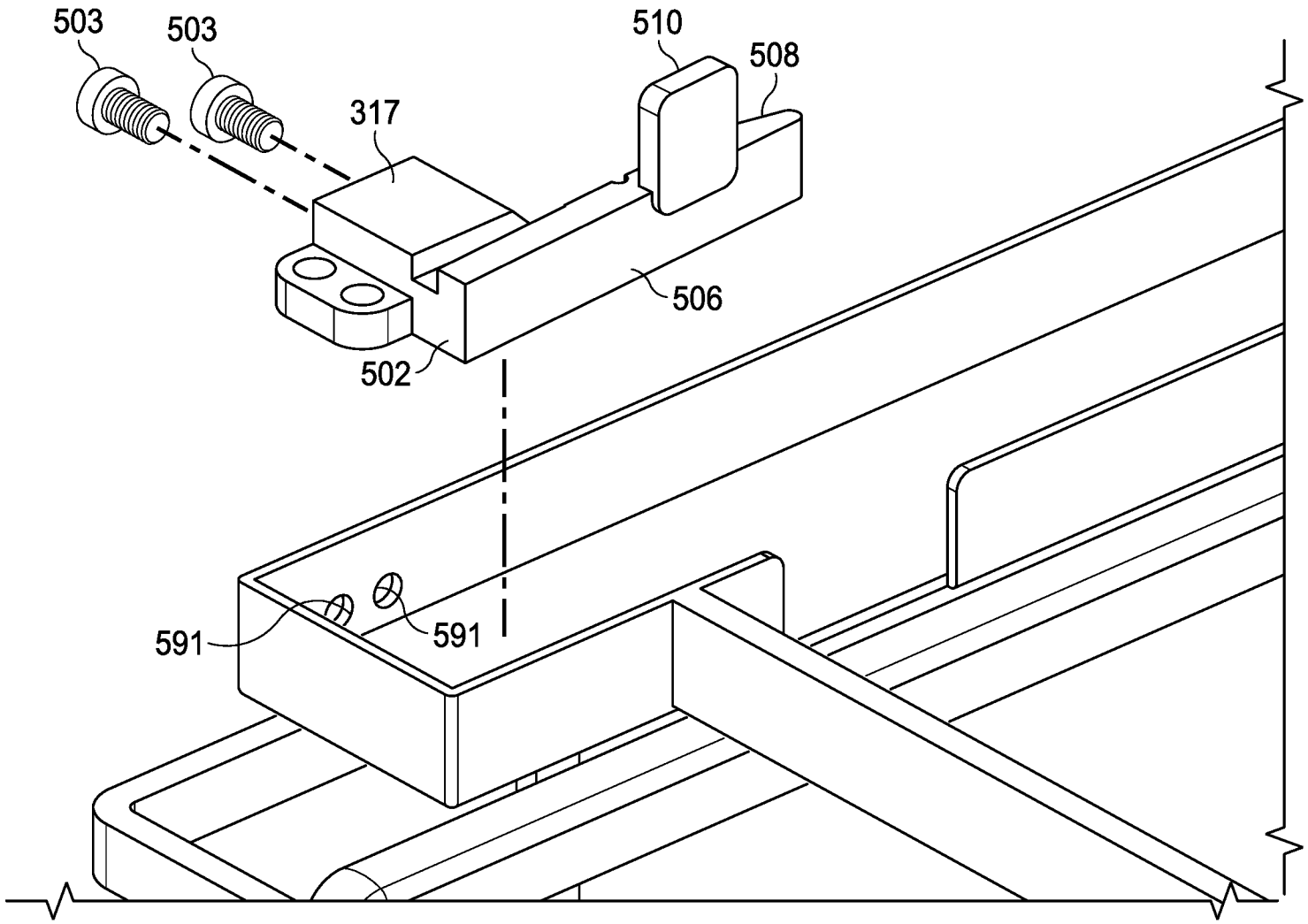
FIG. 5B is an isometric detail view of a preferred embodiment of a drawer slide clip.
Figure 5C:
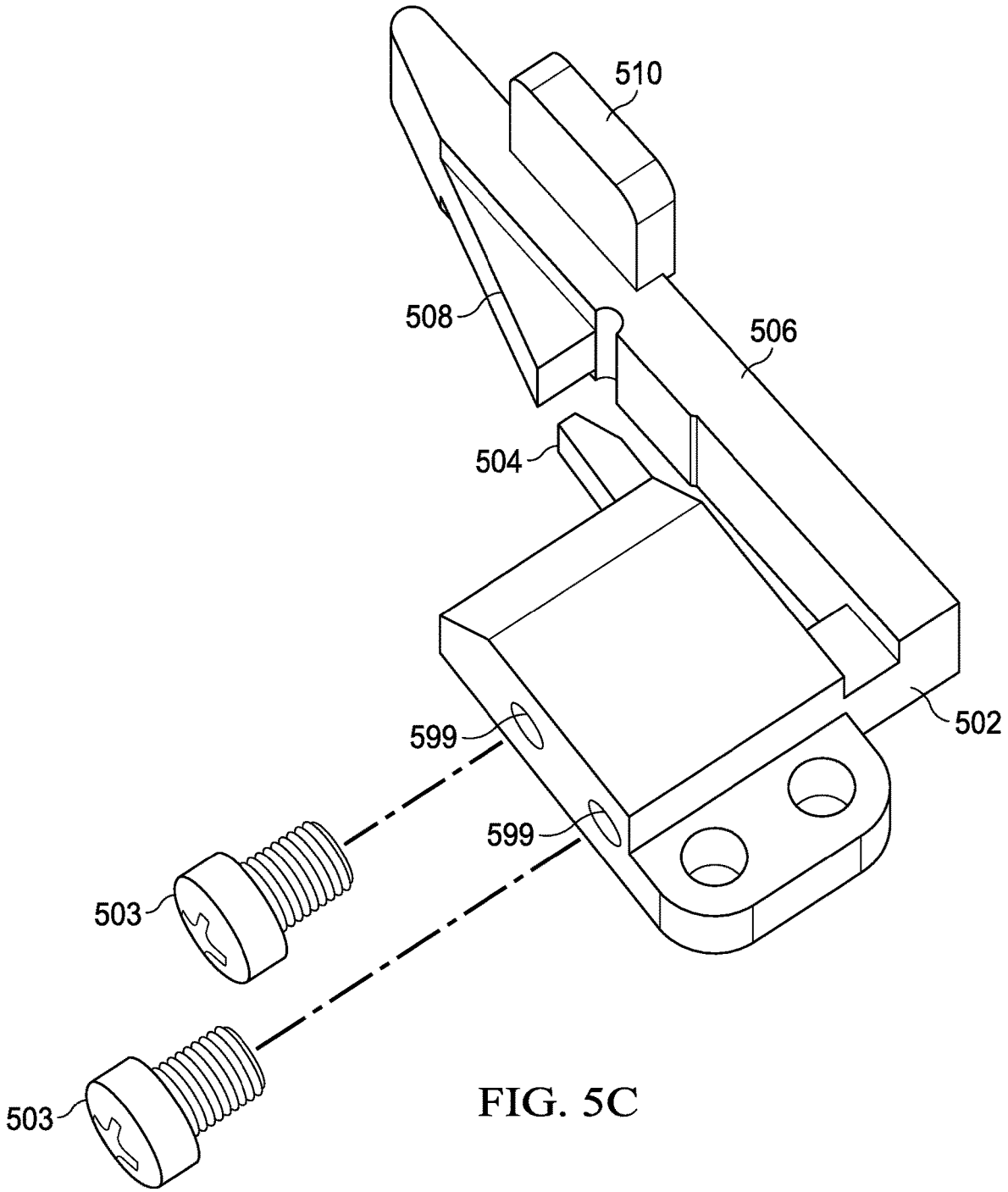
FIG. 5C is an isometric detail view of a preferred embodiment of a drawer slide clip.
Figure 5D:
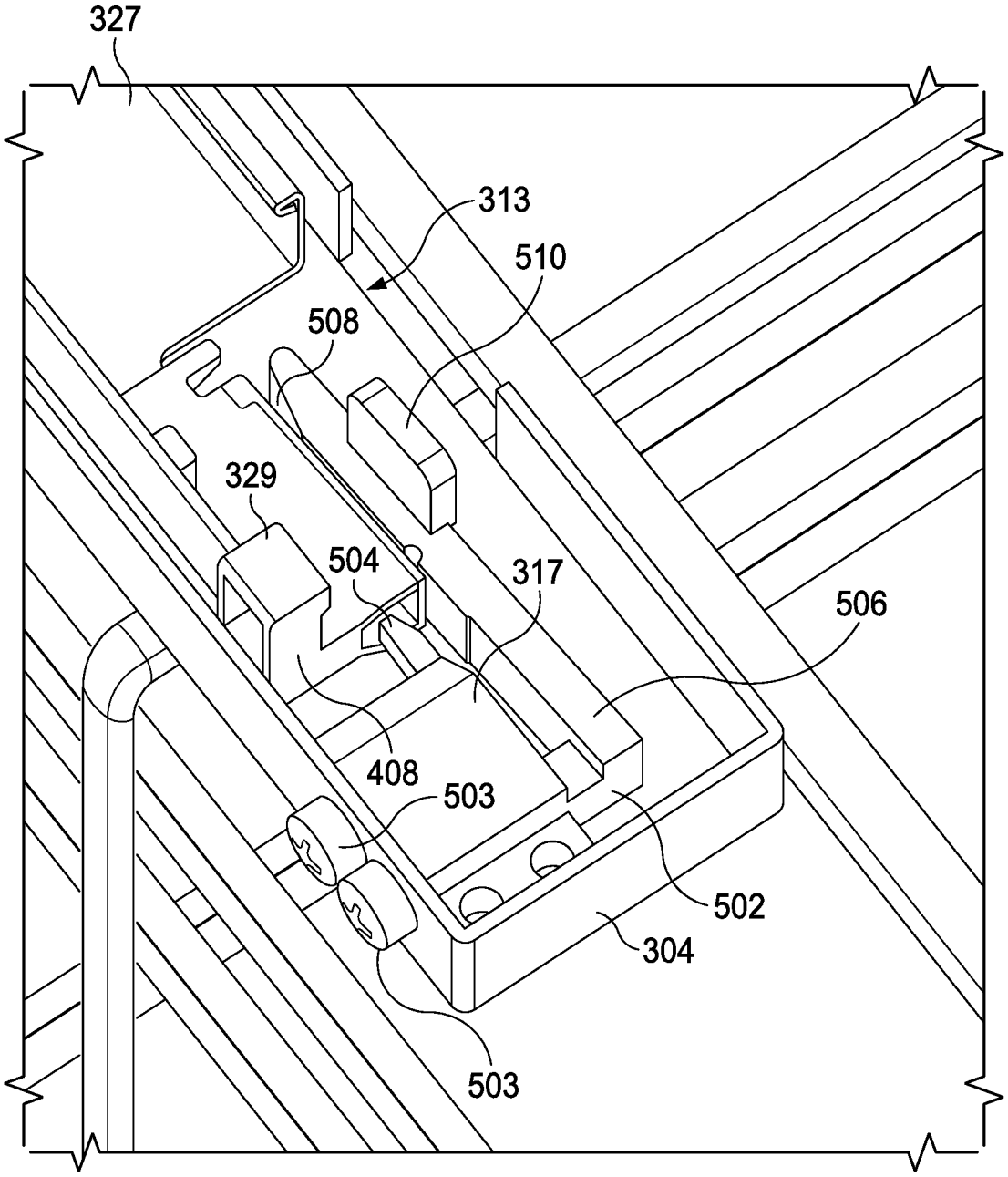
FIG. 5D is an isometric assembly detail.
Figure 6A:
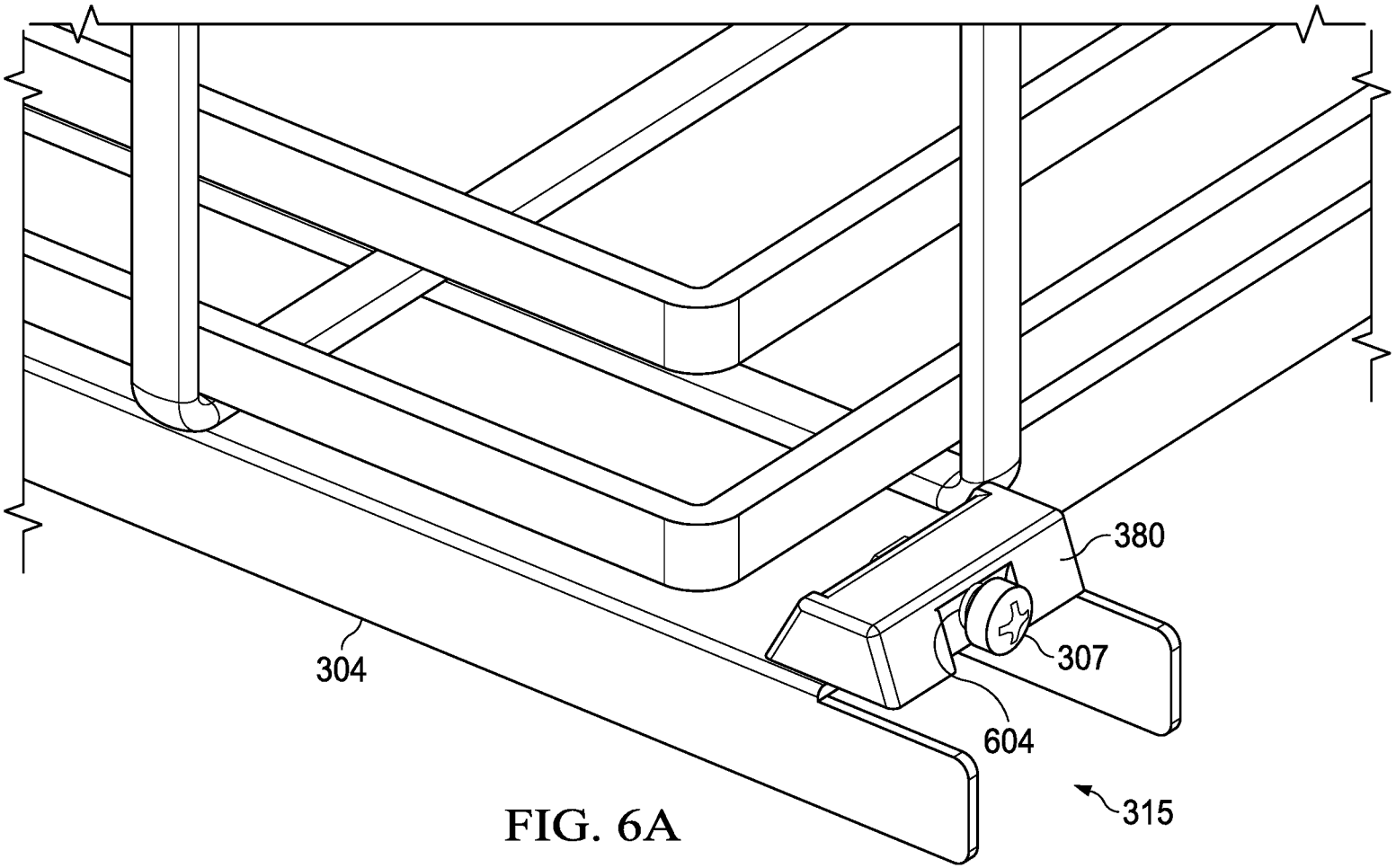
FIG. 6A is an isometric detail view of an abutment block.
Figure 6B:
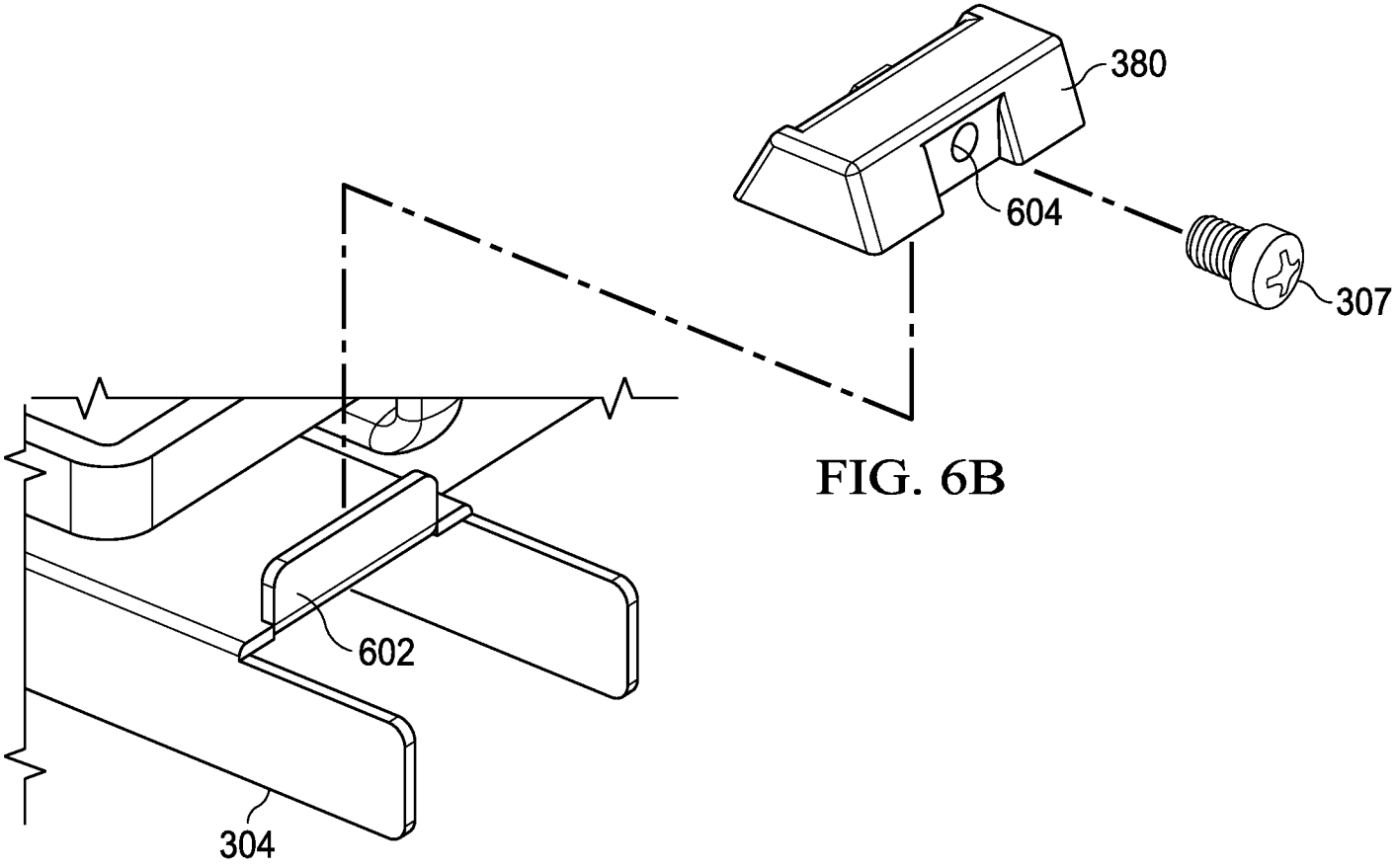
FIG. 6B is an exploded isometric detail view of an abutment block.
Figure 6C:
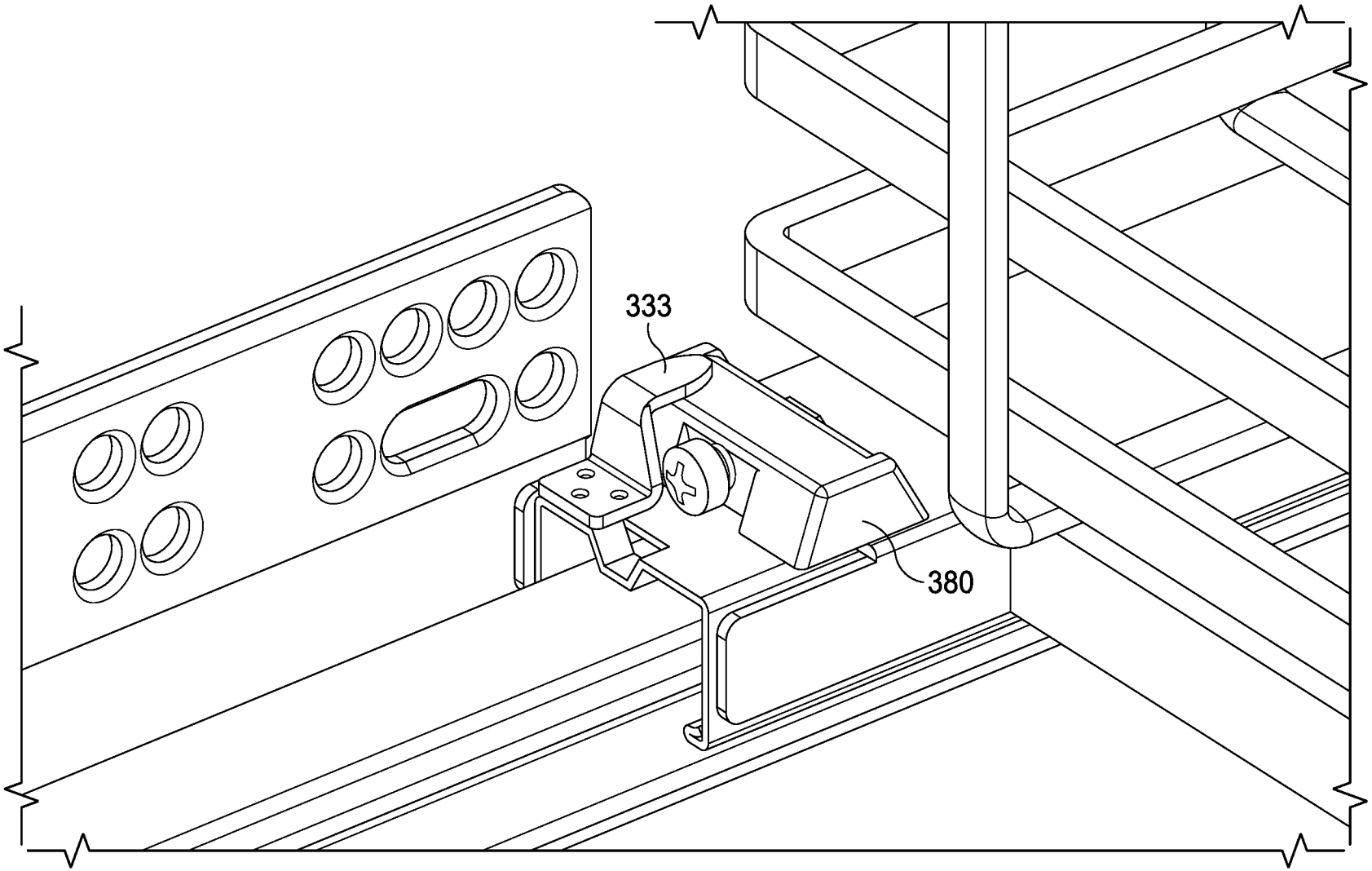
FIG. 6C is an assembly detail view of a drawer catch and abutment block.
Figure 6D:
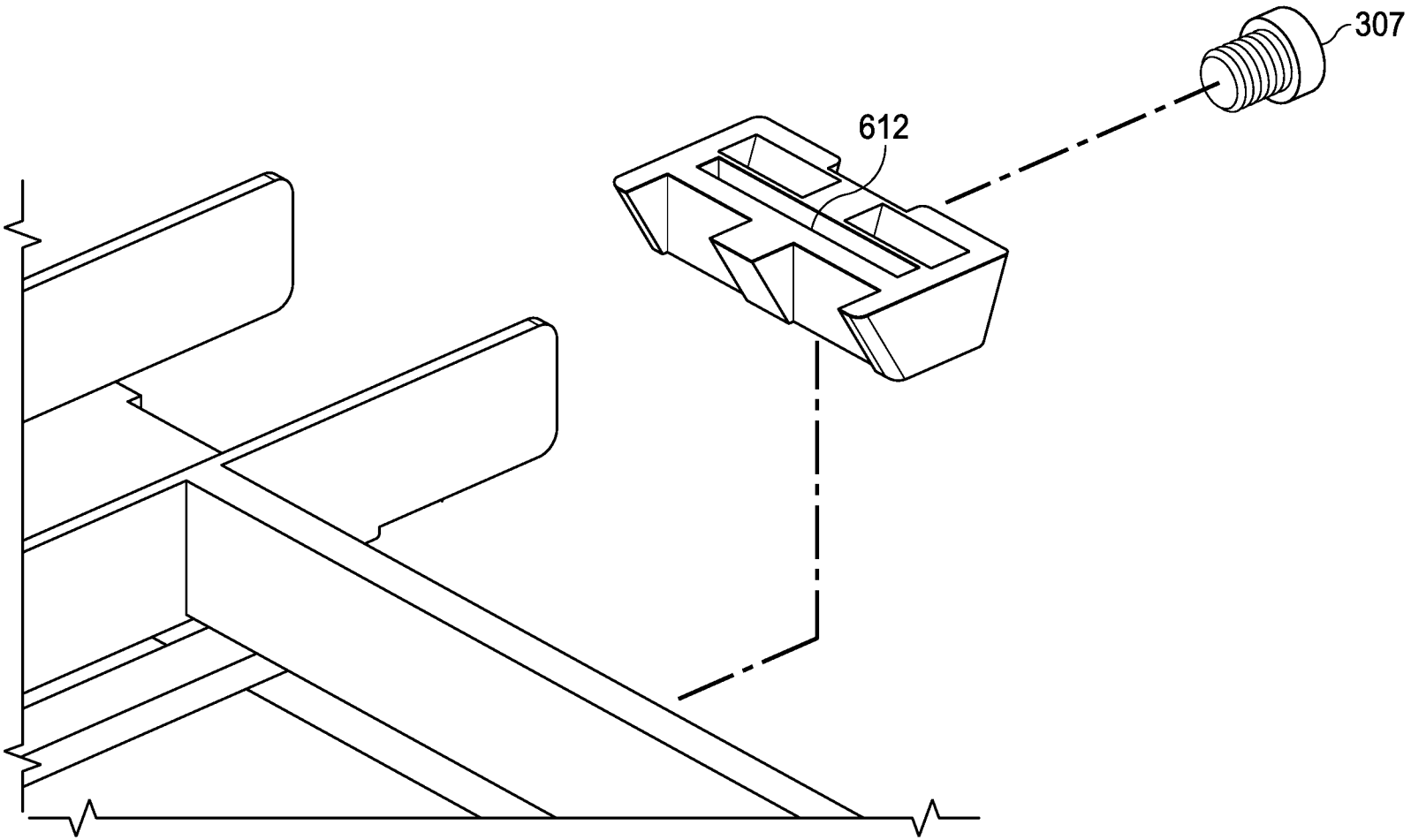
FIG. 6D is an exploded isometric detail view of an abutment block.

Referring to FIG. 4C, right drawer slide catch 333 is shown. Right drawer slide catch 333, in a preferred embodiment, forms a right angle hook, which is secured to the top side of right forward slide rail 327 by rivets or spot welding.

In a preferred embodiment, left drawer slide catch 388 is a mirror image of right drawer slide catch 333 and is positioned at the rear of left forward slide rail 337.

Referring then to FIGS. 5A, 5B, 5C and 5D, right drawer slide clip 317 will be described. Right drawer slide clip 317 comprises support body 502. Support body 502 is attached to right base channel member 304 by screws 503, which pass through holes 591 and are secured in threaded holes 599. Support body 502 is integrally formed with spring arm 506. Spring arm 506 includes latch 508. Latch 508 is triangular in shape and is designed to engage clip receiver 402 of right engagement block 329. Integrally formed with spring arm 506 also is access knob 510. Access knob 510 can be seen to be positioned directly adjacent right access cutout 313. In use, access knob 510 can be moved to engage or disengage latch 508 from clip receiver 402, thereby allowing attachment or removal of the retainer cage assembly from the drawer slide. Support body 502 further comprises centering pin 504. Centering pin 504 is positioned parallel to the central longitudinal axis of right base channel member 304, and is designed to engage engagement clip guide channel 410 adjacent engagement clip stop 408. In its proper position, engagement clip stop 408 is directly adjacent to and abuts support body 502.

In a preferred embodiment, left drawer slide clip 320 is a mirror image of right drawer slide clip 317 and is attached to left base channel member 306 in similar fashion. Left drawer slide clip 320 also functions in a similar way to the right drawer slide clip 317 in that it may be moved to attach and detach the left drawer slide from the retainer cage assembly.

Referring then to FIGS. 6A, 6B, 6C and 6D, right abutment block 380 will be further described. Right base channel member 304 includes upward channel tang 602. In a preferred embodiment, upward channel tang 602 is right angle extension which is integrally formed with right base channel member 304 and is comprised of a light metal alloy or stainless steel. Right abutment block 380 includes threaded hole 604. Right abutment block 380 further includes mounting slot 612. Mounting slot 612 is positioned on upward channel tang 602 and secured by screw 307 through threaded hole 604. In a preferred embodiment, right abutment block 380 is comprised of neoprene, polyvinyl chloride or Teflon. Right abutment block 380 is designed to fit against and underneath right drawer slide catch 333.

In a preferred embodiment, left abutment block 381 is a mirror image of right abutment block 380 and is attached to an upward channel tang on left base channel member 306 in a similar fashion.

Figure 7A:
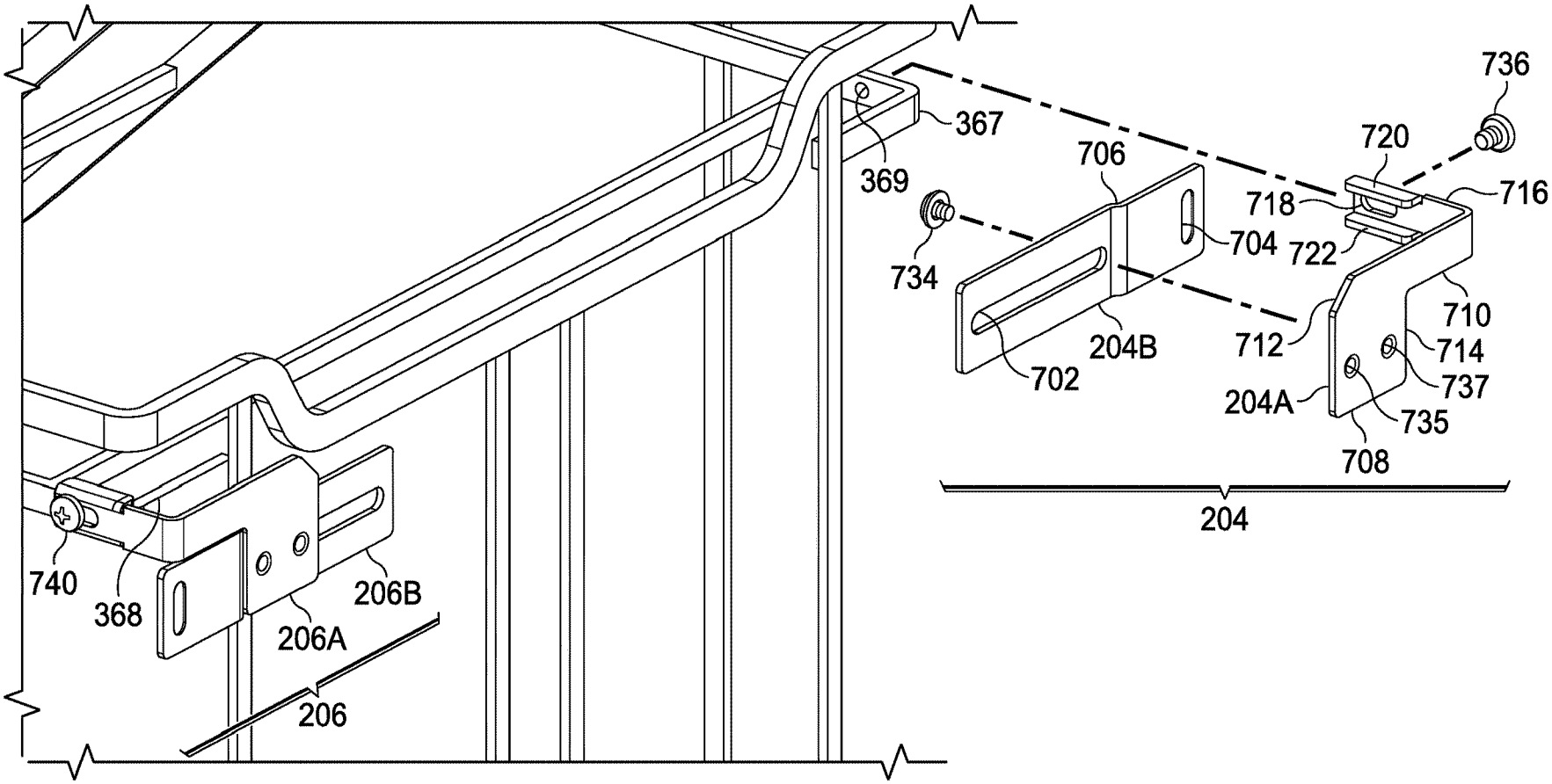
FIG. 7A is an exploded isometric view of a preferred embodiment of an angle bracket.
Figure 7B:
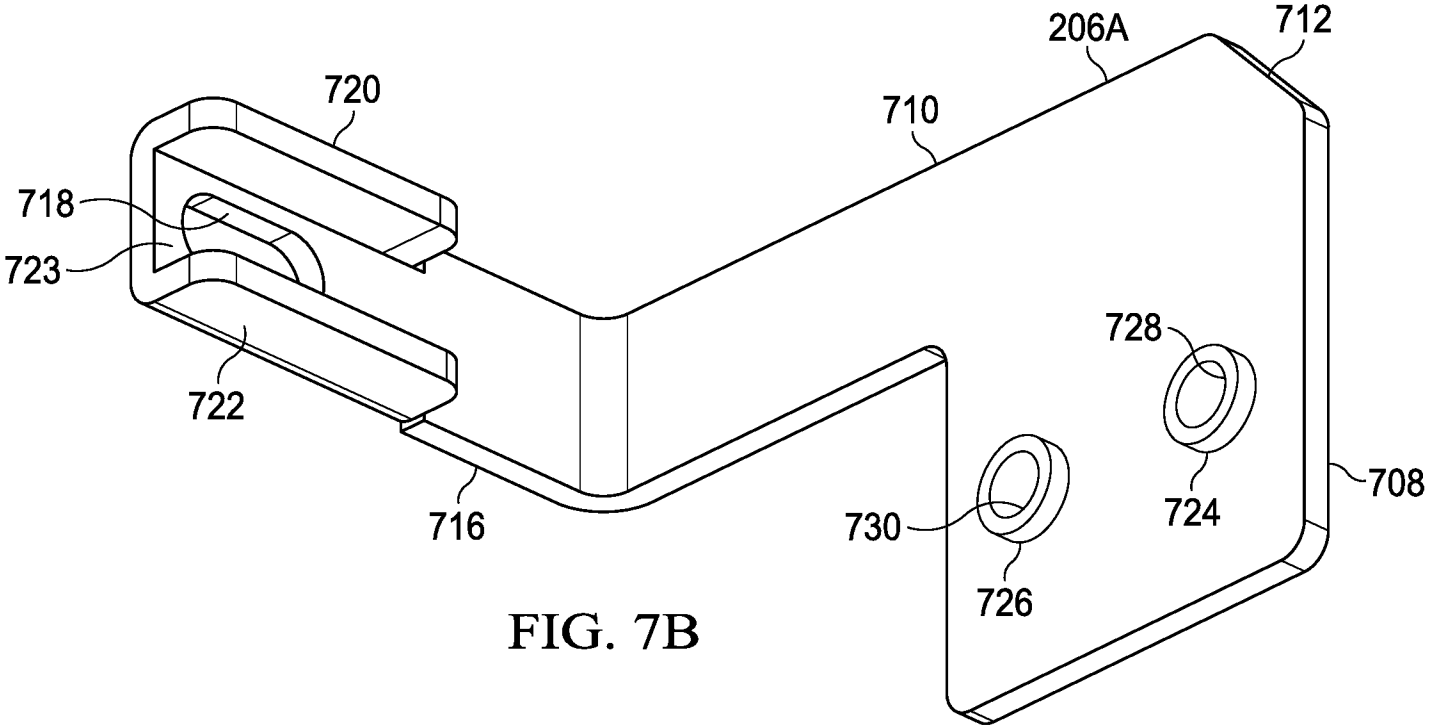
FIG. 7B is an isometric detail view of a preferred embodiment of an angle bracket.

Referring to FIGS. 7A and 7B, the angle brackets will be further described. Adjustment bracket 204 comprises angle bracket 204A and rectangular bracket 204B. Likewise, adjustment bracket 206 comprises angle bracket 206A and rectangular bracket 206B. In a preferred embodiment, angle bracket 206A is a mirror image of angle bracket 204A, likewise, rectangular bracket 206B is a mirror image of rectangular bracket 204B. In a similar way, adjustment bracket 210 is an identical copy of adjustment bracket 204 and adjustment bracket 208 is an identical copy of angle bracket 206. All four adjustment brackets cooperate to move the face plate in an aligned fashion in a depth direction, a horizontal direction and a vertical direction, as will be further described. The aligned movement of the face plate during adjustment is important to maintain the face plate in a plane parallel to the front of the retainer cage assembly and the front face of the drawer box.

Rectangular bracket 204B further comprises horizontal adjustment slot 702, and vertical adjustment slot 704. As can be seen, the horizontal adjustment slot is horizontally oriented and vertical adjustment slot 704 is vertically oriented. Rectangular bracket 204B further comprises stop 706. In a preferred embodiment, rectangular bracket 204B is comprised of stainless steel, or a light cast alloy. Angle bracket 204A comprises lower section 708 adjacent forward section 710. Lower section 708 is bounded by limit edge 714 and clearance corner 712. Lower section 708 is integrally formed with forward section 710 and rearward section 716. Rearward section 716 further comprises depth adjustment slot 718. Depth adjustment slot 718, as can be seen, is longitudinally oriented. Rearward section 716 further comprises upper channel wall 720 and lower channel wall 722. Together, upper channel wall 720 and lower channel wall 722 form guide channel 723. In a preferred embodiment, guide channel 723 is about three sixteenths (3/16) inch in height (±10%). As can be seen best on FIG. 7B, angle bracket 204A includes guide stanchions 724 and 726. Guide stanchion 724 includes threaded hole 728. Guide stanchion 726 includes threaded hole 730. Guide stanchions 724 and 726, in a preferred embodiment, are separately formed cylindrical brass bushings press fit into mounting holes 735 and 737 in lower section 708 and extend outward from lower section 708. The distance that the brass bushings extend from the lower section 708 cannot be greater than the depth of the horizontal slot, such that horizontal set screw 734 can fix the rectangular bracket 204B to the angle bracket 204A, when tightened. When adjustment bracket 204 is assembled, guide stanchions 724 and 726 fit within horizontal adjustment slot 702. The brass bushings, which comprise guide stanchions 724 and 726 are important to reduce noise and accommodate easy sliding motion as the face plate is adjusted horizontally. The brass composition is also important because it reduces wear of the horizontal adjustment slot.

Horizontal set screw 734 is designed to proceed through horizontal adjustment slot 702 and into threaded hole 730. Depth set screw 736 is designed to proceed through depth adjustment slot 718 and into threaded hole 369. Upper channel wall 720 engages the upper side of right upper buttress rail extension 367. Lower channel wall 722 engages the lower side of right upper buttress rail extension 367. The orientation and alignment of the upper channel wall, lower channel wall is important because, in operation, they maintain the vertical orientation of lower section 708 with respect to the entire retainer cage assembly and provide an aligned depth adjustment motion for the face plate.

As can be seen, limit edge 714 is designed to engage stop 706 and form a limit of maximum horizontal travel for the lower section in the rectangular bracket. Likewise, the interference between guide stanchion 726 and horizontal adjustment slot 702 forms a limit of horizontal travel for the lower section in a rectangular bracket. Likewise, the length of depth adjustment slot 718 and the interference between it and depth set screw 736 forms a limit on the depth adjustment provided by the bracket. Likewise, the interference between vertical set screw 752 and vertical adjustment slot 704 forms a vertical limit of travel for the angle bracket. In practice, each of adjustment brackets 204, 206, 208, and 210 are adjusted simultaneously in the manner just described, in order to allow adjustment of face plate 108. The adjustment of the face plate is important because it allows the face plate to be oriented correctly within the drawer box without the need for repeated adjustment of the drawer slides.

All components described with respect to adjustment bracket 206 are mirror images of adjustment bracket 204 and perform in a likewise manner. All components of adjustment brackets 204 and 206 are identical to adjustment brackets 210 and 208, respectively, and perform in a likewise manner.

Figure 7C:
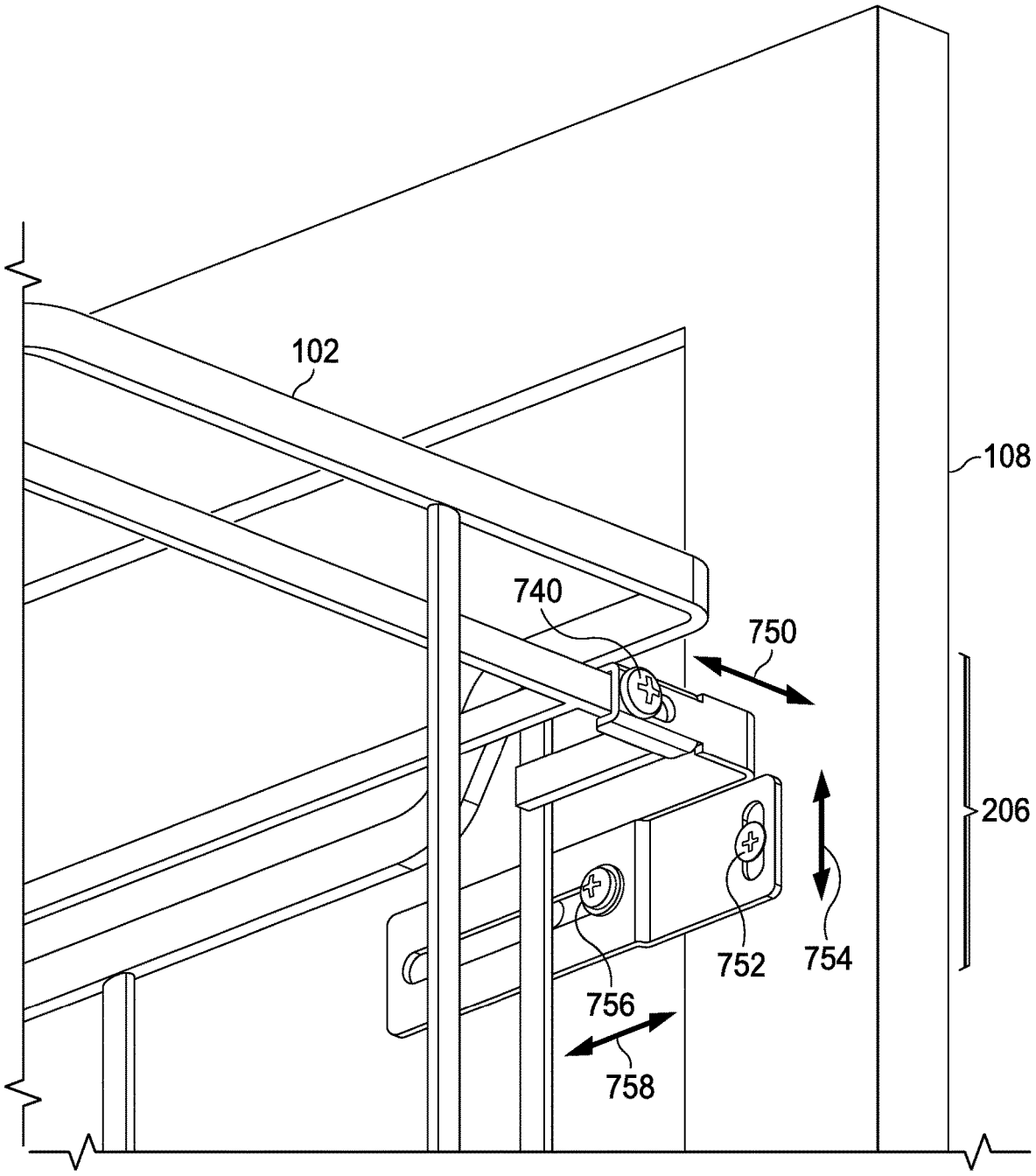
FIG. 7C is an assembly view of a preferred embodiment of an angle bracket.

Referring then to FIG. 7C, the face plate adjustment feature will be further described. Adjustment bracket 206 is shown properly mounted to face plate 108 and retainer cage assembly 102. Loosening depth set screw 740 allows depth adjustment 750. Loosening vertical set screw 752 allows vertical adjustment 754. Loosening horizontal set screw 756 allows horizontal adjustment 758. Tightening the screws fixes the adjustments in place. Each of the adjustment brackets functions in the same way.

Figure 8:
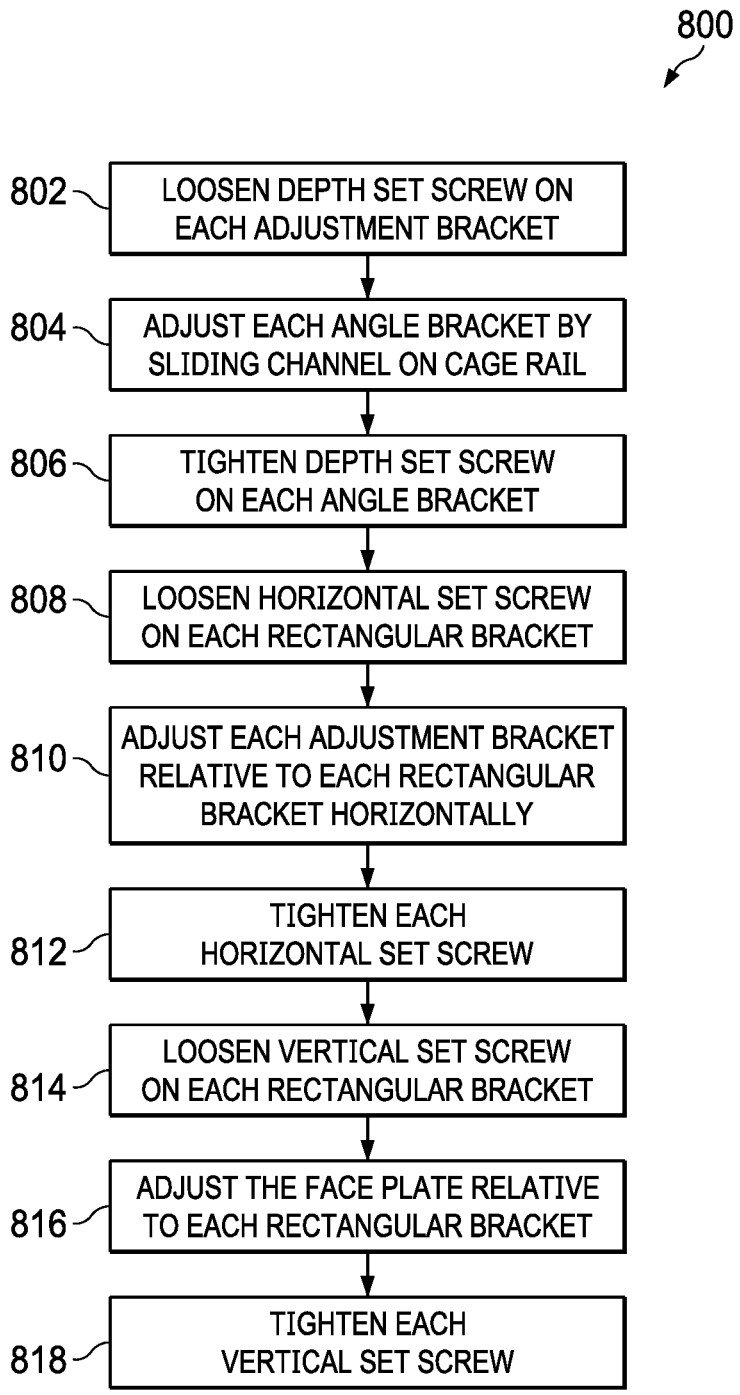
FIG. 8 is a flowchart of a preferred method of adjusting a face plate.

Turning then to FIG. 8, preferred method 800 of adjusting the face plate relative to the cabinet face will be described.

At step 802, the depth set screw on each adjustment bracket is loosened. At step 804, each angle bracket is adjusted by sliding along a channel adjacent a cage rail. At step 806, each depth set screw on each angle bracket is tightened to accomplish a depth adjustment. At step 808, each horizontal set screw on each rectangular bracket is loosened. At step 810, each adjustment bracket is adjusted relative to each rectangular bracket in a horizontal direction. At step 812, each horizontal set screw is tightened to accomplish a horizontal adjustment. At step 814, each vertical set screw on each rectangular bracket is loosened. At step 816, the face plate is adjusted relative to each rectangular bracket in a vertical direction. At step 818, each vertical set screw is tightened to accomplish a vertical adjustment of the face plate.

Figure 9A:
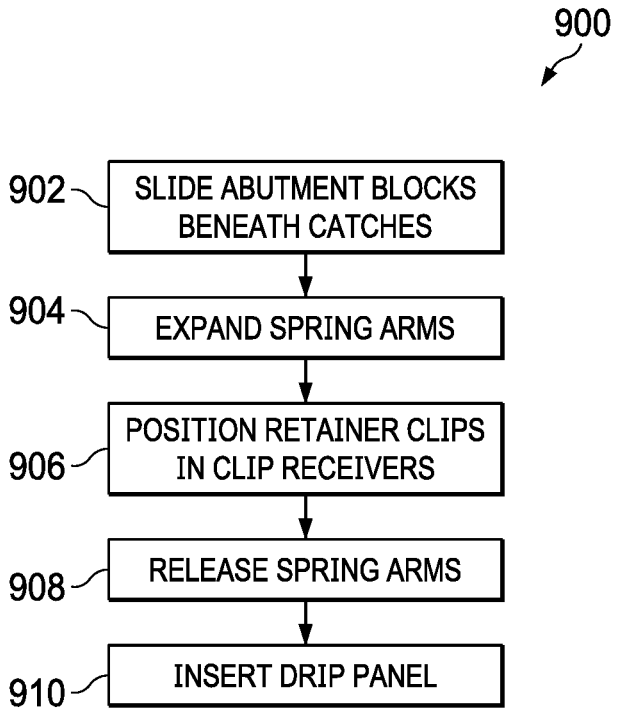
FIG. 9A is a flowchart of a preferred method of attaching a retainer cage assembly.

Referring then to FIG. 9A, flow chart 900 comprises of the steps of a preferred embodiment of the method of attaching the retainer cage assembly to the drawer slides will be described. At step 902, starting with the retainer cage assembly detached from the drawer slides, each of the right and left abutment blocks are simultaneously lodged between each of the right and left drawer slide catches, respectively. At step 904, each of the spring arms of the right and left drawer slide clips are expanded by manipulating each of the access knobs inwardly toward the center of the retainer cage assembly. At step 906, each of the right and left retainer clips is positioned adjacent each of the right and left clip receivers, respectively. At step 908, each of the spring arms is released, thereby allowing each of the latches to enter its respective clip receiver. At step 910, the drip panel is inserted into the retainer cage and fitted adjacent the front latitudinal section and the rear latitudinal section and sealed against the lower perimeter rail, thereby creating a barrier between refuse and the drawer slides beneath.

Figure 9B:
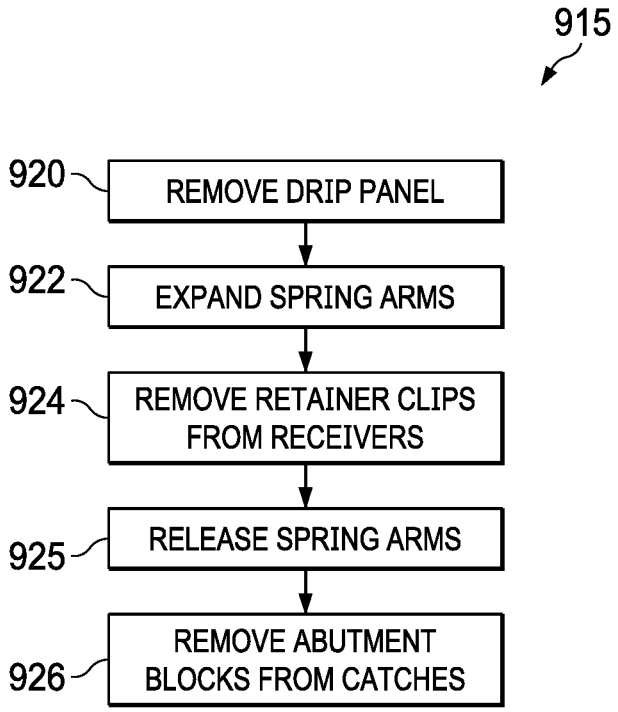
FIG. 9B is a flowchart of a preferred method of detaching a retainer cage assembly.

Referring then to FIG. 9B, the retainer cage assembly may be removed from the drawer slides by following the steps in flow chart 915.

At step 920, the drip panel is removed from the retainer cage by pressing upward from the bottom. At step 922, each of the spring arms of the right and left drawer slide clips are expanded by manipulating each of the access knobs inwardly toward the center of the retainer cage assembly. At step 924, each of the right and left retainer clips is removed from each respective clip receiver. At step 925, each of the spring arms is released. At step 926, the abutment blocks are removed from beneath each of their respective catches.

The invention claimed is:

1. A method of adjusting a face plate attached to a retainer cage assembly, the retainer cage slidably mounted in a drawer box comprising the steps of:

providing an upper right adjustment bracket comprising an upper right angle bracket and an upper right rectangular bracket, wherein the upper right angle bracket further comprises a first rearward section and a first forward section, the first rearward section further comprising a first horizontal oblong hole and a first pair of channel walls adjacent the first oblong hole, the first forward section further comprising a first downward section, the first downward section further comprising a first set of cylindrical bushings, horizontally disposed and oriented toward the retainer cage assembly, the upper right rectangular bracket further comprising a first horizontal slot, wherein the first set of bushings are slidingly positioned within the first horizontal slot so as to horizontally guide a first movement of the upper right angle bracket;

providing an upper left adjustment bracket comprising an upper left angle bracket and an upper left rectangular bracket, wherein the upper left angle bracket further comprises a second rearward section and a second forward section, the second rearward section further comprising a second horizontal oblong hole and a second pair of channel walls adjacent the second oblong hole, the second forward section further comprising a second downward section, the second downward section further comprising a second set of cylindrical bushings, horizontally disposed and oriented toward the retainer cage assembly, the upper left rectangular bracket further comprising a second horizontal slot, wherein the second set of bushings are slidingly positioned within the second horizontal slot so as to horizontally guide a second movement of the upper left angle bracket;

providing a lower right adjustment bracket comprising a lower right angle bracket and a lower right rectangular bracket, wherein the lower right angle bracket further comprises a third rearward section and a third forward section, the third rearward section further comprising a third horizontal oblong hole and a third pair of channel walls adjacent the third oblong hole, the third forward section further comprising a third downward section, the third downward section further comprising a third set of cylindrical bushings, horizontally disposed and oriented toward the retainer cage assembly, the lower right rectangular bracket further comprising a third horizontal slot, wherein the third set of bushings are slidingly positioned to fit within the third horizontal slot as to horizontally guide a third movement of the lower right adjustment bracket;

providing a lower left adjustment bracket comprising a lower left angle bracket and a lower left rectangular bracket, wherein the lower left angle bracket further comprises a fourth rearward section and a fourth forward section, the fourth rearward section further comprising a fourth horizontal oblong hole and a fourth pair of channel walls adjacent the fourth oblong hole, the fourth forward section further comprising a fourth downward section, the fourth downward section further comprising a fourth set of cylindrical bushings, horizontally disposed and oriented toward the retainer cage assembly, the lower left rectangular bracket further comprising a forth horizontal slot, wherein the fourth set of bushings are slidingly positioned to fit within the fourth horizontal slot so as to horizontally guide a fourth movement of the lower left angle bracket;

attaching the upper right adjustment bracket, the upper left adjustment bracket, the lower right adjustment bracket and the lower left adjustment bracket between the retainer cage assembly and the face plate;

adjusting the upper right angle bracket of the upper right adjustment bracket by sliding the first pair of channel walls of the upper right angle bracket along the retainer cage to effect an aligned depth adjustment of the face plate;

adjusting the upper left angle bracket of the upper left adjustment bracket by sliding the second pair of channel walls of the upper left angle bracket along the retainer cage to effect the aligned depth adjustment of the face plate;

adjusting the lower right angle bracket of the lower right adjusting bracket by sliding the third pair of channel walls of the lower right angle bracket along the retainer cage to effect the aligned depth adjustment of the face plate; and, adjusting the lower left angle bracket of the lower left adjustment bracket by sliding the fourth pair of channel walls of the lower left angle bracket along the retainer cage to effect the aligned depth adjustment of the face plate.

2. The method of claim 1 further comprising the steps of:

adjusting the upper right angle bracket relative to the upper right rectangular bracket to effect an aligned horizontal adjustment of the face plate;

adjusting the upper left angle bracket relative to the upper left rectangular bracket to effect the aligned horizontal adjustment of the face plate;

adjusting the lower right angle bracket relative to the lower right rectangular bracket to effect the aligned horizontal adjustment of the face plate; and, adjusting the lower left angle bracket relative to the lower left rectangular bracket to effect the aligned horizontal adjustment of the face plate.

3. The method of claim 2 further comprising the steps of:

adjusting the upper right rectangular bracket relative to the face plate to effect an aligned vertical adjustment of the face plate;

adjusting the upper left rectangular bracket relative to the face plate to effect the aligned vertical adjustment of the face plate;

adjusting the lower right rectangular bracket relative to the face plate to effect the aligned vertical adjustment of the face plate; and, adjusting the lower left rectangular bracket relative to the face plate to effect the aligned vertical adjustment of the face plate.

4. The method of claim 3 further comprising the steps of:

adjusting the face plate to match a position of the drawer box.

5. The method of claim 3 further comprising the steps of:

adjusting the face plate to match a position of a pullout drawer system.

6. The method of claim 3 further comprising the steps of:

providing a drip panel; and, inserting the drip panel into the retainer cage assembly.

7. The method of claim 6 further comprising the steps of:

providing a container; and, inserting the container into the retainer cage assembly.

8. A method of installing a pullout drawer comprising the steps of:

providing a drawer box;

providing a first cross brace;

providing a second cross brace;

providing a first drawer slide;

providing a second drawer slide;

providing a retainer cage assembly comprising a base frame;

providing a first retainer clip of the base frame comprising a first access knob, a first spring arm, a first clip body, and a first retainer clip latch;

providing a second retainer clip of the base frame comprising a second access knob, a second spring arm, a second clip body, and a second retainer clip latch;

attaching the first cross brace to the drawer box;

attaching the second cross brace to the drawer box;

connecting the first drawer slide to both the first cross brace and the second cross brace;

connecting the second drawer slide to both the first cross brace and the second cross brace;

attaching the retainer cage assembly to the first drawer slide and the second drawer slide;

simultaneously sliding a first abutment block of the base frame beneath a first catch of the first drawer slide and a second abutment block of the base frame beneath a second catch of the second drawer slide;

retracting the first spring arm of the first retainer clip away from the first clip body by the first access knob;

retracting the second spring arm of the second retainer clip away from the second clip body by the second access knob;

placing the first retainer clip adjacent a first clip receiver of the first drawer slide;

placing the second retainer clip adjacent a second clip receiver of the second drawer slide;

releasing the first spring arm toward the first clip body by releasing the first access knob;

releasing the second spring arm toward the second clip body by releasing the second access knob;

engaging the first retainer clip latch in the first clip receiver;

engaging the second retainer clip latch in the second clip receiver;

thereby engaging the first retainer clip to the first drawer slide and engaging the second retainer clip to the second drawer slide;

providing a face plate connected to the retainer cage assembly;

providing an upper right adjustment bracket, an upper left adjustment bracket, a lower right adjustment bracket and a lower left adjustment bracket all attached between the retainer cage assembly and the face plate;

adjusting an upper right angle bracket of the upper right adjustment bracket by sliding a first pair of channel walls of the upper right angle bracket along the retainer cage to effect an aligned depth adjustment of the face plate;

adjusting an upper left angle bracket of the upper left adjustment bracket by sliding a second pair of channel walls of the upper left angle bracket along the retainer cage to effect the aligned depth adjustment of the face plate;

adjusting a lower right angle bracket of the lower right adjusting bracket by sliding a third pair of channel walls of the lower right angle bracket along an exterior of the retainer cage to effect the aligned depth adjustment of the face plate; and, adjusting a lower left angle bracket of the lower left adjustment bracket by sliding a fourth pair of channel walls of the lower left angle bracket along the exterior of the retainer cage to effect the aligned depth adjustment of the face plate.

9. The method of claim 8 further comprising the steps of:

adjusting the upper right angle bracket relative to an upper right rectangular bracket to effect an aligned horizontal adjustment of the face plate;

adjusting the upper left angle bracket relative to an upper left rectangular bracket to effect the aligned horizontal adjustment of the face plate;

adjusting the lower right angle bracket relative to a lower right rectangular bracket to effect the aligned horizontal adjustment of the face plate; and, adjusting the lower left angle bracket relative to a lower left rectangular bracket to effect the aligned horizontal adjustment of the face plate.

10. The method of claim 9 further comprising the steps of:

adjusting the upper right rectangular bracket relative to the face plate to effect an aligned vertical adjustment of the face plate;

adjusting the upper left rectangular bracket relative to the face plate to effect the aligned vertical adjustment of the face plate;

adjusting the lower right rectangular bracket relative to the face plate to effect the aligned vertical adjustment of the face plate; and, adjusting the lower left rectangular bracket relative to the face plate to effect the aligned vertical adjustment of the face plate.

11. The method of claim 8 further comprising the steps of:

adjusting the face plate to match a position of the drawer box.

12. The method of claim 8 further comprising the steps of:

adjusting the face plate to match a position of a pullout drawer system.

13. The method of claim 8 wherein the step of providing the drawer box further comprises:

providing a right side mount bracket; and, providing a left side mount bracket.

14. The method of claim 13, wherein the step of attaching the first cross brace to the drawer box comprises mounting the first cross brace to both the right side mount bracket and the left side mount bracket; and, wherein the step of attaching the second cross brace to the drawer box comprises mounting the second cross brace to both the right side mount bracket and the left side mount bracket.

* * * * *